US008542081B2

(12) United States Patent
Parekh et al.

(10) Patent No.: US 8,542,081 B2
(45) Date of Patent: Sep. 24, 2013

(54) MOLDED ORTHOMODE TRANSDUCER

(75) Inventors: Sharad Vinodrai Parekh, Dallas, TX (US); Kevin Mark Skinner, Gainesville, GA (US); Donald Lawson Runyon, Duluth, GA (US); David Mark Kokotoff, Alpharetta, GA (US)

(73) Assignee: ViaSat, Inc., Carlsbad, CA (US)

( * ) Notice: Subject to any disclaimer, the term of this patent is extended or adjusted under 35 U.S.C. 154(b) by 832 days.

(21) Appl. No.: 12/614,185

(22) Filed: Nov. 6, 2009

(65) Prior Publication Data

US 2010/0141543 A1 Jun. 10, 2010

Related U.S. Application Data

(60) Provisional application No. 61/113,517, filed on Nov. 11, 2008.

(51) Int. Cl.
*H01P 1/02* (2006.01)
*H01P 1/165* (2006.01)
*H01P 5/12* (2006.01)

(52) U.S. Cl.
USPC ..... 333/135; 333/21 A; 333/126; 333/249

(58) Field of Classification Search
USPC ..... 333/239, 248, 249, 21 A, 125, 127, 333/126, 129, 135
See application file for complete search history.

(56) References Cited

U.S. PATENT DOCUMENTS 2,754,483 A * 7/1956 Zaleski ..... 333/248
3,740,756 A 6/1973 Sosin
4,504,805 A * 3/1985 Ekelman et al. ..... 333/126
5,122,810 A 6/1992 Nisbet et al.
5,434,575 A 7/1995 Jelinek et al.
5,614,874 A 3/1997 McCandless
6,087,908 A 7/2000 Haller et al.
6,323,819 B1 11/2001 Ergene
6,512,485 B2 1/2003 Luly
6,563,398 B1 * 5/2003 Wu ..... 333/137
7,109,938 B2 9/2006 Franson
2002/0171597 A1 11/2002 Krishmar-Junker
2002/0175875 A1 11/2002 Verstraeten
2003/0067364 A1 4/2003 Beis et al.
2005/0259026 A1 11/2005 Cook
2007/0075909 A1 4/2007 Flynn
2007/0296518 A1 12/2007 Avramis
2009/0224990 A1 9/2009 Cezanne et al.

OTHER PUBLICATIONS

Notice of Allowance dated Mar. 15, 2012 in U.S. Appl. No. 12/268,840.

(Continued)

*Primary Examiner* — Benny Lee
*Assistant Examiner* — Gerald Stevens
(74) *Attorney, Agent, or Firm* — Snell & Wilmer LLP

(57) ABSTRACT

In an exemplary embodiment, a dual-band four-port orthomode transducer (OMT) is molded or cast. The OMT may be external to a transceiver housing or included as an integrated portion of the transceiver housing or a drop-in module. In an exemplary embodiment, a four-port OMT is formed from two pieces, the two pieces having a joint adjacent to or aligned to the axis of the common port. In an exemplary embodiment, the OMT is substantially planar and formed of a split-block embodiment. The two OMT pieces are joined and held together with a plurality of discrete fasteners. Furthermore, the OMT is configured to switch polarizations. The polarization switching is initiated using a remote signal and can facilitate load balancing.

16 Claims, 19 Drawing Sheets

(56) References Cited

OTHER PUBLICATIONS

International Preliminary Report on Patentability dated May 18, 2012 in Application No. PCT/US2010/030849.
International Search Report and Written Opinion dated Dec. 3, 2010 in PCT Application No. PCT/US10/30849.
International Preliminary Report on Patentability dated May 26, 2011 in PCT Application No. PCT/US09/63605.
Office Action dated Aug. 1, 2012 in U.S. Appl. No. 13/539,721.
International Search Report and Written Opinion for PCT/US09/63605 dated Sep. 16, 2010.
Office Action dated Jan. 5, 2012 in U.S. Appl. No. 12/268,840.
Office Action dated Dec. 10, 2012 in U.S. Appl. No. 12/758,942.
Notice of Allowance dated Nov. 13, 2012 in U.S. Appl. No. 13/539,721.

* cited by examiner

WITH DRAFT AND RADII
FOR MANUFACTURING

AS INITIALLY DESIGNED
(PRIOR ART)

Distribution Pattern

Practical Distribution Illustration

MOLDED ORTHOMODE TRANSDUCER

CROSS-REFERENCE TO RELATED APPLICATIONS

This application is a non-provisional of and claims priority to U.S. Provisional Patent Application No. 61/113,517, entitled "MOLDED ORTHOMODE TRANSDUCER" and filed Nov. 11, 2008, which is hereby incorporated by reference.

FIELD OF INVENTION

The application relates to systems, devices, and methods for transmitting and receiving signals in a satellite communications antenna system. More particularly, the application relates to a dual-band multi-port waveguide component used in an antenna having dual-linear or circular polarization and configuring the component for a molded or cast fabrication process of manufacture.

BACKGROUND OF THE INVENTION

With reference to prior art FIG. 1, in some ground based satellite communication antenna systems 100, a single antenna (feed horn) 120 is connected to a transceiver 101, where the transceiver combines the functionality of both a transmitter and a receiver. In these embodiments, typically, the transceiver has a transmit port and a receive port. The transmit and receive ports are connected to an antenna feed 105. Antenna feed 105 generally comprises an orthomode transducer (OMT) 130, a polarizer 110, and feed horn 120.

The feed horn, in this satellite communications antenna system arrangement, is a component that can convey RF signals to/from a remote location, such as a satellite. Feed horn 120 is connected to polarizer 110 and communicates transmit and receive radio frequency (RF) signals between the polarizer and the feed horn. Typically, signals communicated between feed horn 120 and polarizer 110 are circularly polarized. Polarizer 110 is configured to convert linearly polarized signals to circular polarized signals and vice versa. Thus, in linearly polarized systems, a polarizer is not required and feed horn 120 connects directly to OMT 130. Although described as two signals, the linearly polarized signals and circular polarized signals are communicated through a single port of polarizer 110 to a common port of OMT 130. Moreover, the transmit and receive signals remain isolated due to at least one, or any combination of, polarization, frequency, and time diversity.

Antenna systems for satellite communications may be configured to operate in two distinct frequency band segments where a first band segment is used to receive signals on a forward link and the second band segment is used to transmit signals on a return link from the satellite. Signals and information on each of the frequency band segments may be contained in single or dual orthogonal polarizations. Moreover, the orthogonal polarizations may be used to isolate the signals to increase capacity through frequency reuse. Military and commercial satellite systems may operate in the high frequency spectrum of frequencies known as K-band and Ka-band, which are about 20 GHz and about 30 GHz, respectively. A typical satellite antenna system operating in K/Ka-band may be configured to transmit and receive using circular polarization and may have opposite sense polarizations as one method of isolating signals in the system. For example, a transmit signal may be on a right hand circular polarization and a receive signal may be on the orthogonal left hand circular polarization sense. The quality of the circular polarization is an important factor in signal isolation. A high degree of circularity or low axial ratio in the antenna system equipment, namely the antenna optics and the RF feed components, increases the polarization performance characteristics and net system performance.

With momentary reference to prior art FIG. 1, OMT 130 may be external to transceiver 101. In addition to the common port, OMT 130 further comprises a transmit port and a receive port that are connected to matching ports on the transceiver housing. Thus, OMT 130 serves as a waveguide configured to connect a common port with at least a transmit port and a receive port. The common port may support two orthogonal polarizations. Furthermore, the common port may support two orthogonal polarizations in two distinct band segments, such as K/Ka-band. The OMT acts as a combiner/splitter of an RF signal so that a receive signal and a transmit signal can be communicated through the same feed horn with orthogonal polarizations.

The use of dual-circular polarization may present additional requirements on the feed system due to the operational nature of circularly polarized signals. Circularly polarized signals change sense or become the opposite polarity upon reflection from an impedance mismatch or discontinuity along the RF signal path. The single or multiple reflected circular polarization signals in a constrained or guided RF signal path can have deleterious effects on system performance in systems that use polarization to isolate signals. Multiple reflected signals may degrade the polarization performance of a co-polarized, or same sense polarization, signal through an interference effect. Single or multiple reflected signals may degrade the isolation to a cross-polarized, or opposite sense polarization, signal through a coupling effect.

Although this satellite antenna system is successfully employed in many systems, a need exists for high performing antenna systems that address issues of cost, ease of assembly, robustness, and tight manufacturing tolerances and the like due to operation at high frequency bands such as K/Ka-band.

First, there is a need in a dual band antenna system operating with dual-circular polarization to terminate unwanted signal reflections to eliminate or minimize multiple reflections that may degrade the polarization quality. Moreover, the dual-band four-port OMT needs tight manufacturing tolerance values for high frequency operations in order to achieve good performance. Thus, it is desirable to have an OMT that is amenable to high volume, low cost manufacturing techniques and that is robust and achieves high performance. More specifically it is desirable to have a dual-band four-port OMT that can be molded or cast in as few as two pieces.

Thus, a need exists for improved satellite antenna systems, methods and devices for addressing these and other issues.

SUMMARY OF THE INVENTION

In accordance with various aspects of the present invention, a method and system for a molded or cast dual-band four-port orthomode transducer (OMT) is presented. The OMT may be external to a transceiver housing or included as an integrated portion of the transceiver housing or a drop-in module. In an exemplary embodiment, a four-port OMT is formed from two pieces, the two pieces having a joint adjacent to or aligned to the axis of the common port. The two OMT pieces are joined and held together with a plurality of discrete fasteners such as screws or rivets.

In a second exemplary embodiment a dual-band four-port OMT is formed inside a transceiver housing a housing base and a sub-floor component. Neither the housing base nor the sub-floor component alone is configured to operate as an OMT. In an exemplary embodiment, a portion of the OMT is cast into the housing base and is part of the transceiver housing. In yet another embodiment, the four-port OMT is configured as a drop-in OMT for integration into a transceiver housing.

Furthermore, in an exemplary embodiment, an antenna system includes a feed horn, a polarizer, and a dual-band four-port OMT comprising two molded or cast sections. The dual-band four-port OMT may be external or internal to a transceiver housing.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

In accordance with an exemplary embodiment, a dual-band antenna feed system comprises a feed horn, a polarizer, and a waveguide. In an exemplary embodiment, the waveguide is an orthomode transducer (OMT). An exemplary OMT comprises a common port and four associated signal ports in the dual-band system. In brief, of the four signal ports, a first pair of signal ports is configured for transmission of signals in a first frequency band segment. A second pair of signal ports is for transmission of signals in a second frequency band segment. The signal ports of each pair are orientated orthogonally to each other, corresponding to orthogonal polarizations. Furthermore, one signal port of each pair of signal ports corresponds to the same polarization as in the other frequency band segment. In other words, one signal port of each pair has the same polarization. Thus, this exemplary OMT has four waveguide ports in addition to the common port.

Although described in various exemplary embodiments in greater detail herein, a split-block OMT, in an exemplary embodiment, is any OMT formed by connecting two or more structural pieces, where an individual piece alone is incapable of functioning as an OMT. In an exemplary embodiment, the OMT is a split-block module or component that may be external or internal to a transceiver housing. If the OMT is internal to the transceiver housing, in one exemplary embodiment, the OMT may be an integral part of the transceiver housing. In other words, at least one of the first piece or second piece is formed by casting or molding features into the transceiver housing. The OMT may be said to be "integral" with the transceiver housing when at least one of the two structural pieces forming the OMT is also part of the housing itself. In this way, the same structure that forms the OMT is, for example, also functional as an enclosure, as a heatsink, and/or as a structure supporting a transceiver circuit board. The transceiver housing may contain draft features internal to the waveguide channels extending from the parting line or junction of the two parts.

Figure 1:
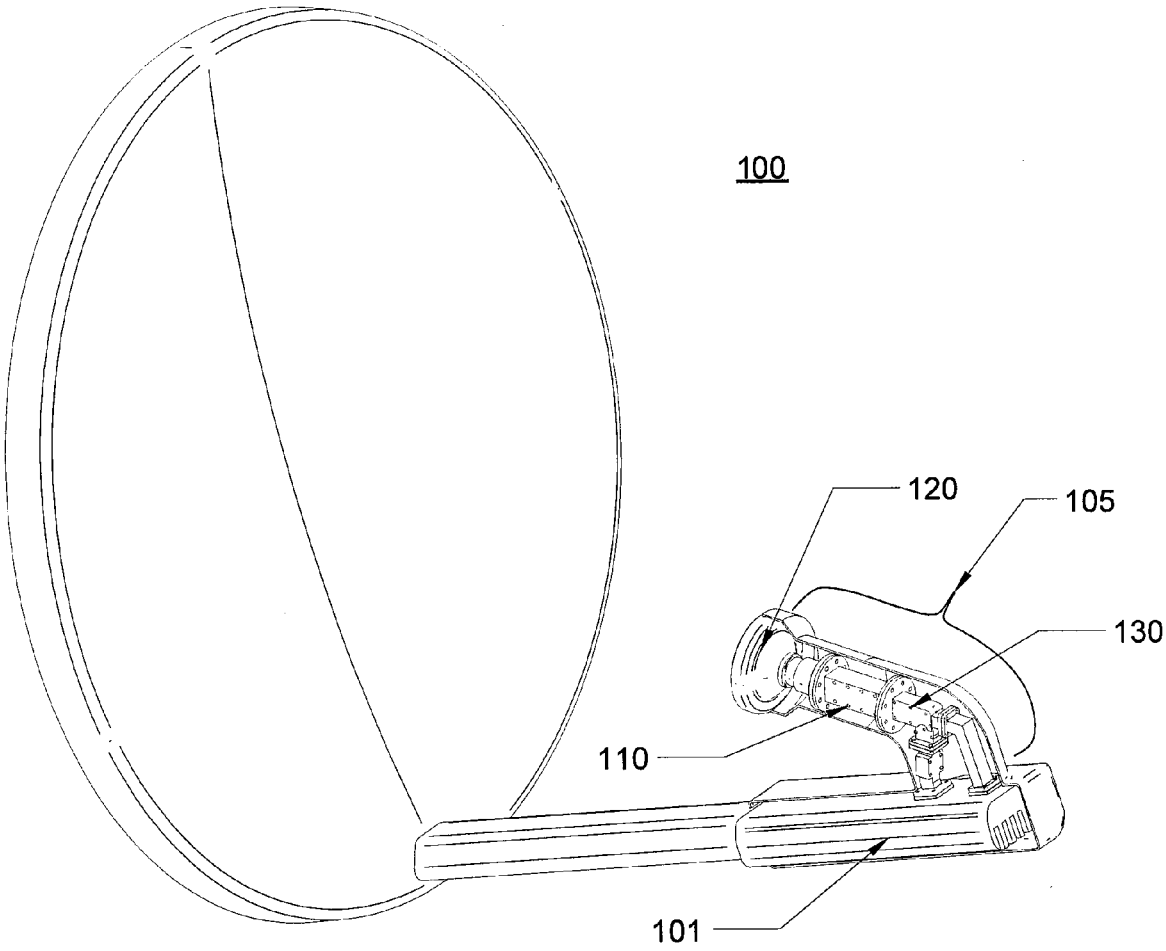
Figure 1. Prior Art
FIG. 1 illustrates a prior art antenna feed in connection with a transceiver.
Figure 2A:
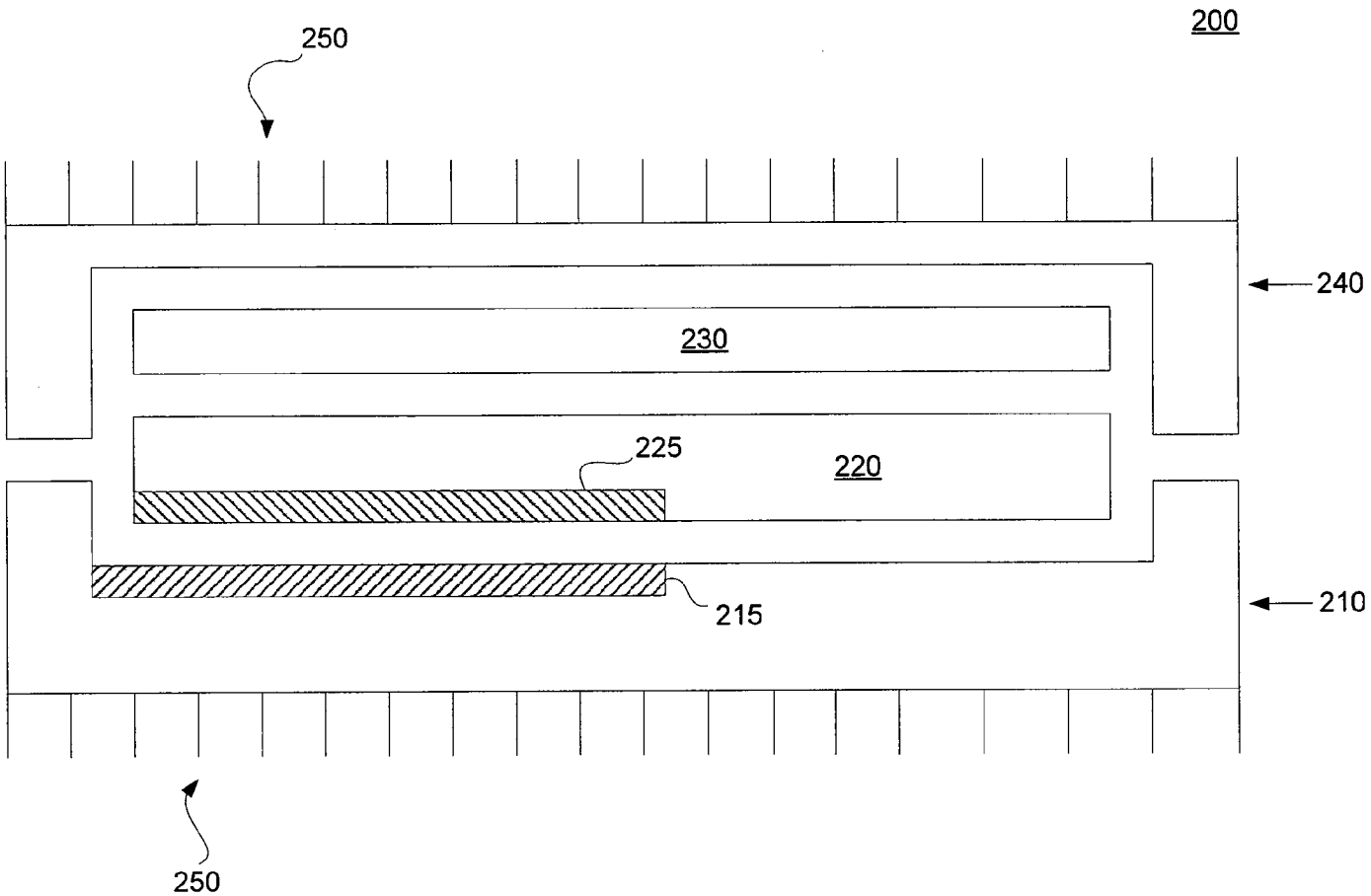
FIG. 2A illustrates a cross-sectional view of an exemplary integrated transceiver.
Figure 2B:
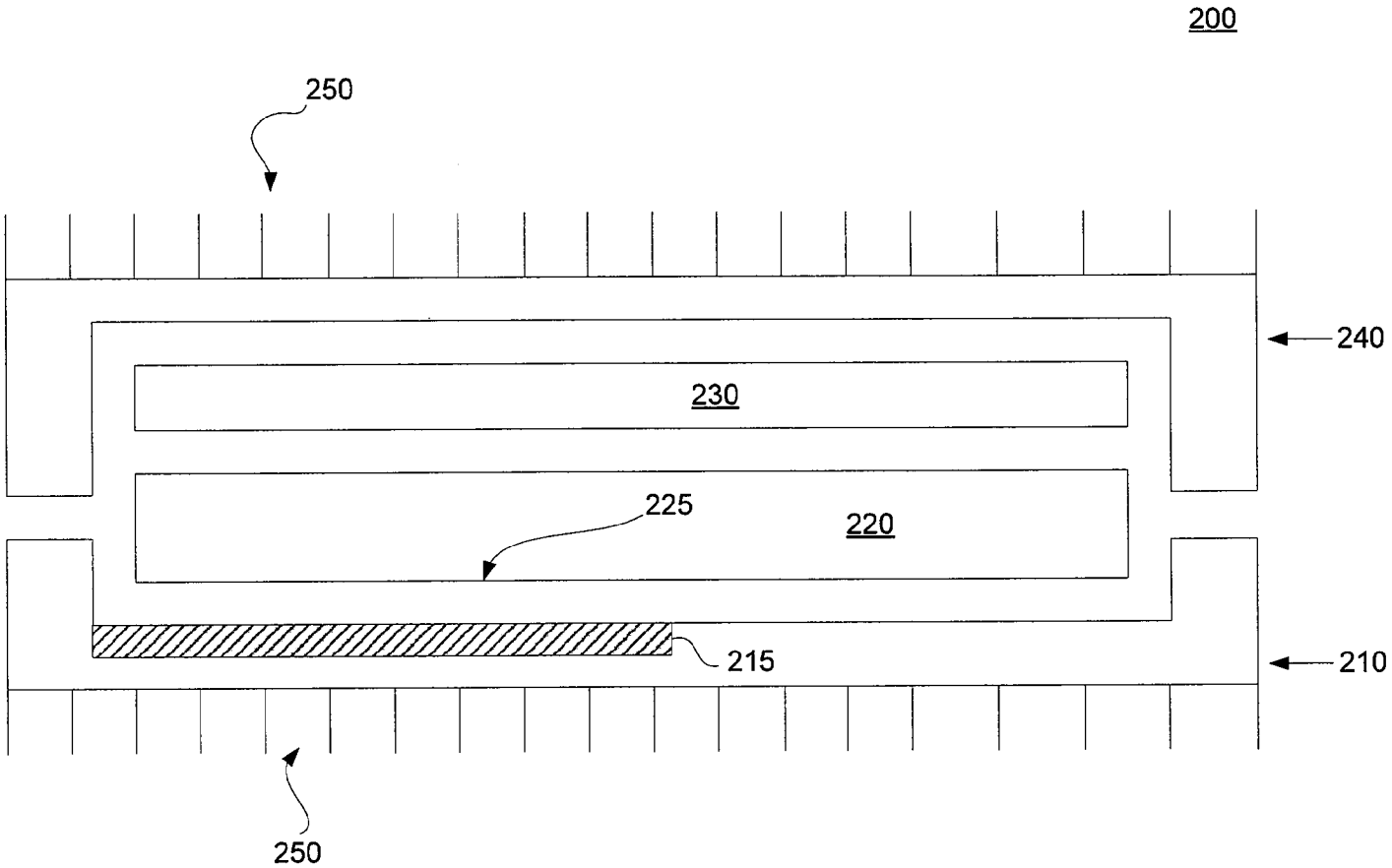
FIG. 2B illustrates a cross-sectional view of another exemplary integrated transceiver.
Figure 2C:
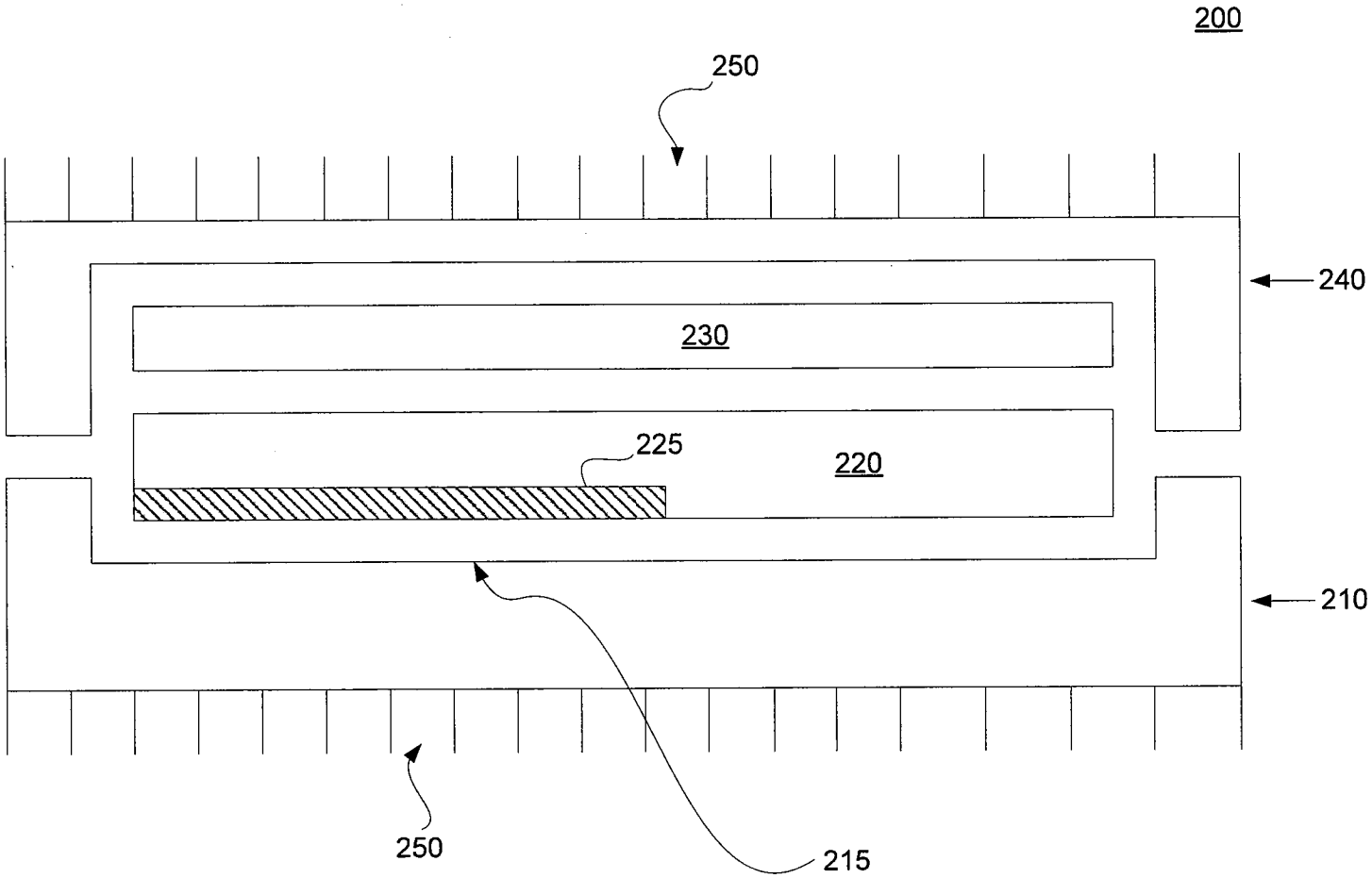
FIG. 2C illustrates a cross-sectional view of yet another exemplary integrated transceiver.

FIGS. 2A-2C illustrate an OMT integrated with a transceiver housing. In accordance with an exemplary embodiment, a transceiver 200 comprises a housing base 210 and a housing cover 240. In an exemplary embodiment, housing base 210 and/or housing cover 240 may comprise fins 250. Fins 250 may facilitate heat transfer away from the housing portions. Transceiver 200 may further comprise a transceiver PCB assembly 230. In an exemplary embodiment, transceiver PCB assembly 230 is internal to transceiver 200. Transceiver PCB assembly 230 may be supported on sub-floor component 220. In an exemplary embodiment, housing base 210 comprises a first OMT portion 215. Sub-floor component 220 may comprise a second OMT portion 225.

In accordance with an exemplary embodiment, a first OMT portion 215 aligns with a second OMT portion 225 of a housing base 210. In an exemplary embodiment, first OMT portion 215 and second OMT portion 225 are complementary to each other. In other words, at least the OMT related structures in the two portions are substantially mirrored. First and second OMT portions 215 and 225 combine to form a split-block OMT. In an exemplary embodiment, the OMT structures are substantially symmetric. In other exemplary embodiments, the two structures are not symmetric.

Various embodiments of the integrated split block OMT are contemplated, including different divisions of the OMT portions between first OMT portion 215 and second OMT portion 225. In one exemplary embodiment and with reference to FIG. 2B, first OMT portion 215 is cast with all, or substantially all, of a relief of the OMT, and second OMT portion 225 is flat, or substantially flat. By flat, it should be understood that second OMT portion 225 primarily forms a lid for the waveguide, but contains little more of the waveguide structure. In a second embodiment and with reference to FIG. 2C, first OMT portion 215 is flat, or substantially flat, and second OMT portion 225 is cast with all, or substantially all, of a relief of the OMT. Moreover, the OMT may be divided between the first and second OMT portion 215, 225 using any ratio or percentage of division. In an exemplary embodiment, first and second OMT portions 215, 225 are divided to be substantially equal and take into consideration the draft angles.

Figure 3B:
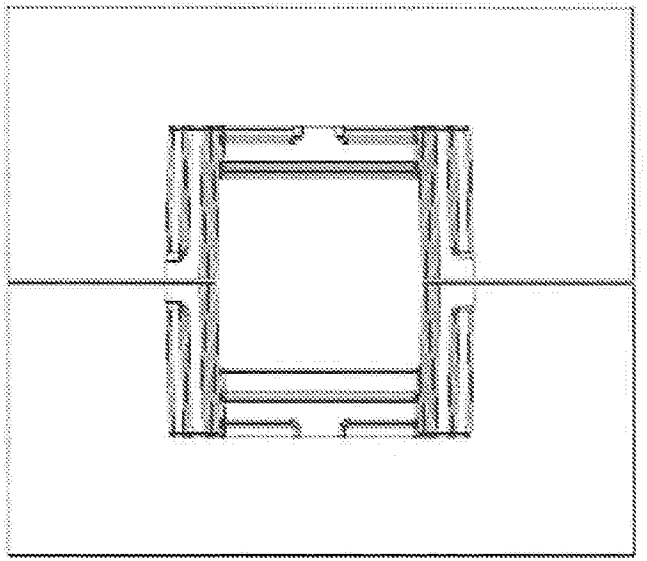
FIG. 3B illustrate an exemplary common waveguide channel with draft angles.
Figure 3A:
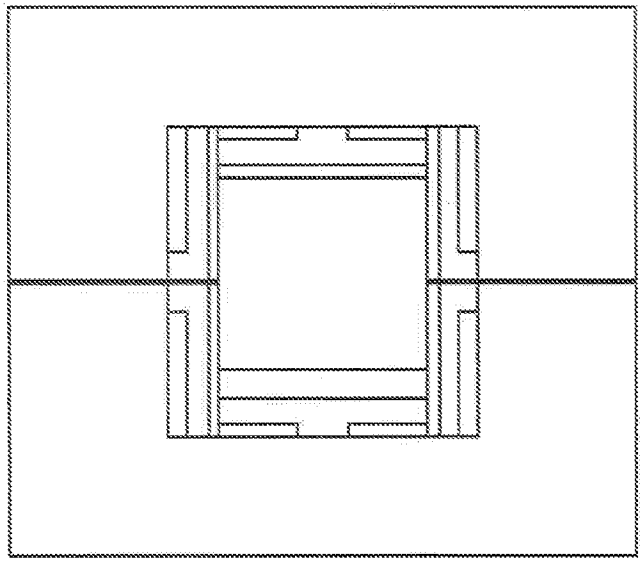
FIG. 3A illustrates a prior art initial design of an exemplary common waveguide channel.

In accordance with a prior art embodiment and with reference to FIG. 3A, the waveguide channels throughout an OMT structure and ports of an OMT are typically designed with a basic cross-section that is square or rectangular. In other words, the conventional approach to internal features of an OMT fabricated by machining or electroforming processes is to implement internal features that are square or rectangular. In an exemplary embodiment, the internal features of the OMT structure are designed for draft if needed for casting or molding fabrication process. The conventional approach may also include radius features on corners or edges.

In contrast, in an exemplary embodiment the waveguide design is modified for manufacturing purposes such that the cross-section is moderately hexagonal. An exemplary hexagonal structure is illustrated in FIG. 3B. When the hexagonal cross-section is bisected, this results in through regions that are slightly trapezoidal in cross-section shape. Moreover, the cross-section shape could have any angle such that the sides of cross-section form a trapezoidal shape. The trapezoidal cross-section features are desirable for low cost manufacturing methods such as casting or molding.

The trapezoidal cross-section may also be known as drafts or draft angles. In an exemplary embodiment, the draft angles are designed transverse to the axis of the common port and may also occur along the axis of the port in some regions. The drafting features affect the electrical design and performance of the OMT and are accounted for in the design for the RF performance. The details of the minimum draft angles and minimum channel or feature sizes are dependent upon the material used for molding or casting. In an exemplary embodiment, the OMT components are cast from at least one of zinc, aluminum, plastic or other suitable materials as would be known in the art. For example, Ultem™ is a dimensionally stable plastic material that may be molded and subsequently plated with an electrically conducting material. Ultem™ is a resin developed by GE Plastics and now owned by SABIC Innovative Plastic™, a division of Saudi Basic Industries Corporation.

In another exemplary embodiment, interior features of the waveguide channels generally do not include any sharp corners or edges except at the edges of the two parts that complete the waveguide channel of the OMT assembly. The radius transitions form junctions between interior features and facilitate material distribution during molding or casting fabrication. This can have the benefit of reducing wear on the tool used in fabrication. Additionally, electrical contact along the full extent of the joining edges forming the perimeter of the waveguide channels affects the RF performance. Any cracks or gaps generally results in higher loss of the RF signal power and may reduce polarization quality and overall signal isolation performance between ports. Thus, in an exemplary embodiment, the OMT is designed without cracks or gaps. Furthermore, in another exemplary embodiment, the OMT comprises features that increase the contact pressure along the joining edges.

In an exemplary embodiment, the OMT comprises pressure ridges near the waveguide channels. Pressure ridges may be formed by cutting away or casting such that material is removed in portions away from the edges forming the perimeter of the waveguide channels. In particular, pressure ridges are formed at the junction of the two OMT portions pressed together using fasteners. Thus, a tight edge joint is formed.

In an exemplary embodiment, an OMT comprises waveguides with cross-sections that are substantially square, rectangular, or hexagonal in shape. A rectangular waveguide may be advantageous over a circular cross-section in a two-part bifurcated OMT design because the polarization modes may be more easily maintained in their originally launched orientation throughout the OMT structure. Circular cross-sections allow for continuous mode degeneracy of the orientation for any single launched mode and the degree of circular cross-section must be maintained to a high degree.

In an exemplary embodiment, an OMT comprises two orthogonal waveguide modes in a common waveguide channel supporting operation for two different polarizations. In a specific embodiment, the two orthogonal waveguide modes are TE10 and TE01 dominant modes in the generally rectangular waveguide mode. In an exemplary embodiment, the dominant mode is the propagating mode for carrying signal energy and is the lowest order mode in the waveguide channel. Additional degenerate modes or higher order modes may be problematic and may lead to lower polarization isolation, as well as higher undesired cross-polarization energy. For casting or molding in two parts this dimensional, continuous mode degeneracy may be problematic with a circular cross-section and the overall performance can be far more sensitive to achieving a dual orthogonal mode condition in a cast or molded assembly comprised of two parts split in this manner.

Figure 4:
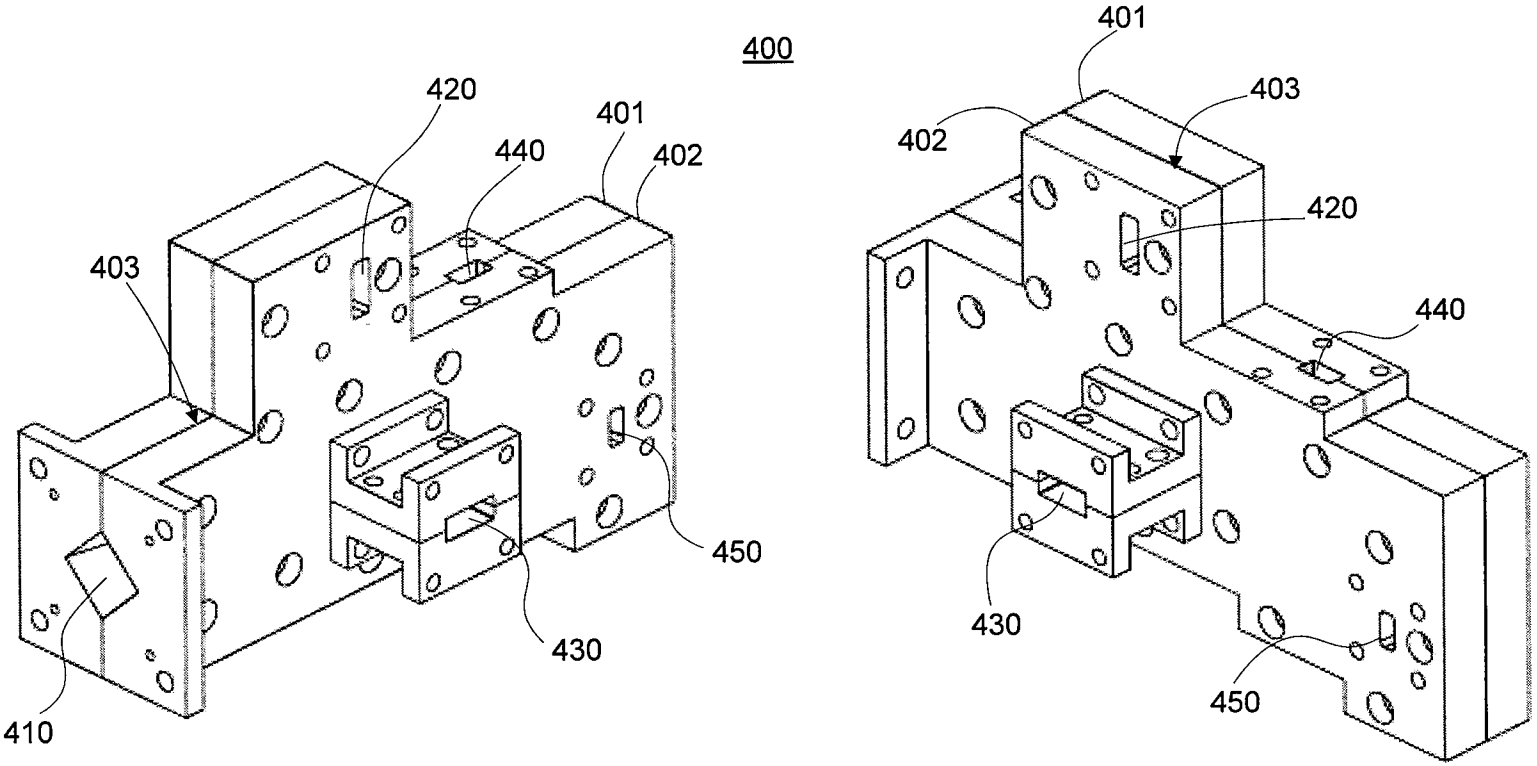
FIG. 4 illustrates an exemplary split-block four-port orthomode transducer.

In accordance with an exemplary embodiment of the present invention and with reference to FIG. 4, an OMT 400 comprises a first piece 401 and a second piece 402. In particular the OMT comprises a common port 410 and four additional ports 420, 430, 440, 450. The four additional ports 420, 430, 440, 450 can be individually associated with a particular frequency band segment and polarization. In an exemplary embodiment, first piece 401 and second piece 402 substantially bisect the OMT assembly along a principal axis 403 of a common waveguide channel. In addition to the various ports, and with reference to FIGS. 5A and 5B, OMT 400 further comprises a common waveguide transition area 415, a first transition area 425, a second transition area 435, and a third transition area 445, where the transition areas are within waveguide channels.

Figure 5A:
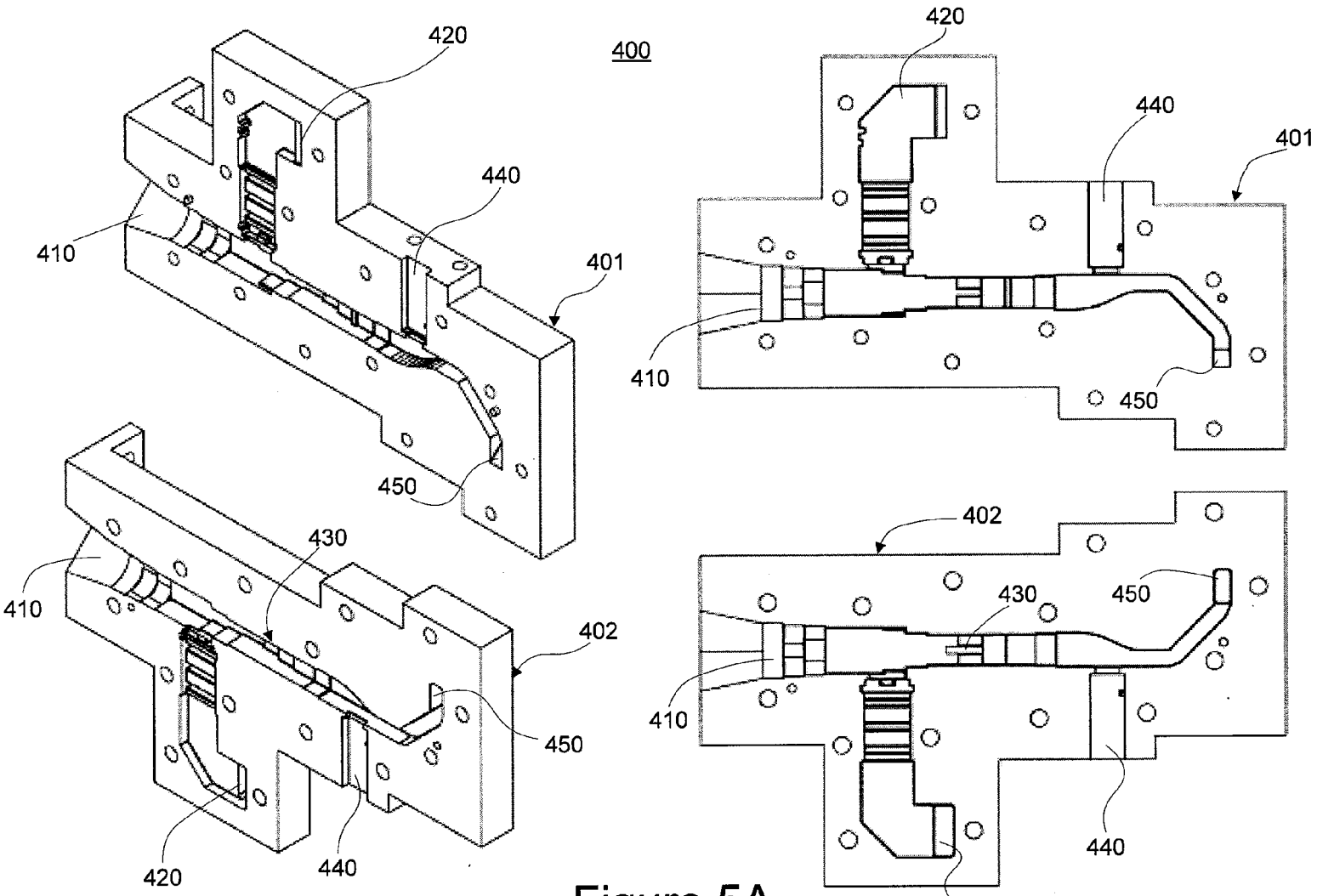
FIG. 5A illustrates cross-sectional and perspective views of an exemplary split-block four-port orthomode transducer.
Figure 5B:
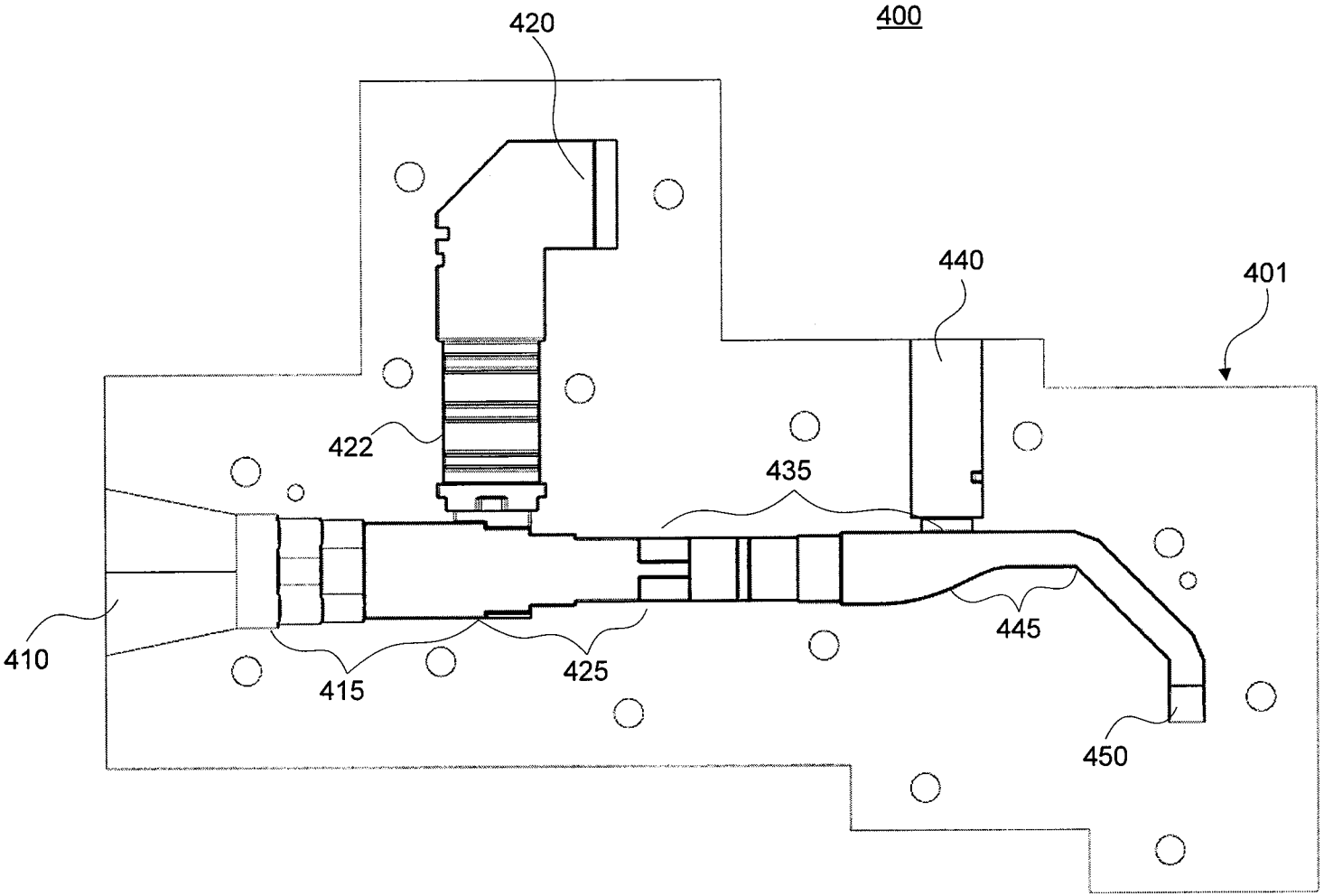
FIG. 5B illustrates a cross-sectional view of an exemplary split-block four-port orthomode transducer.

With continued reference to FIGS. 5A and 5B, OMT 400 further comprises a Ka-band reject waveguide filter 422 in the waveguide channel associated with port 420. The Ka-band reject filter reflects Ka-Band signals that may exist at or near the junction of port 420 with the common waveguide transition area 415. The Ka-band reject filter serves to isolate co-polarized signals between port 420 and port 440. In another exemplary embodiment, a second Ka-band reject filter may be operatively connected to port 430 to isolate signals between the output of the second Ka-band reject filter and co-polarized port 450.

Figure 6A:
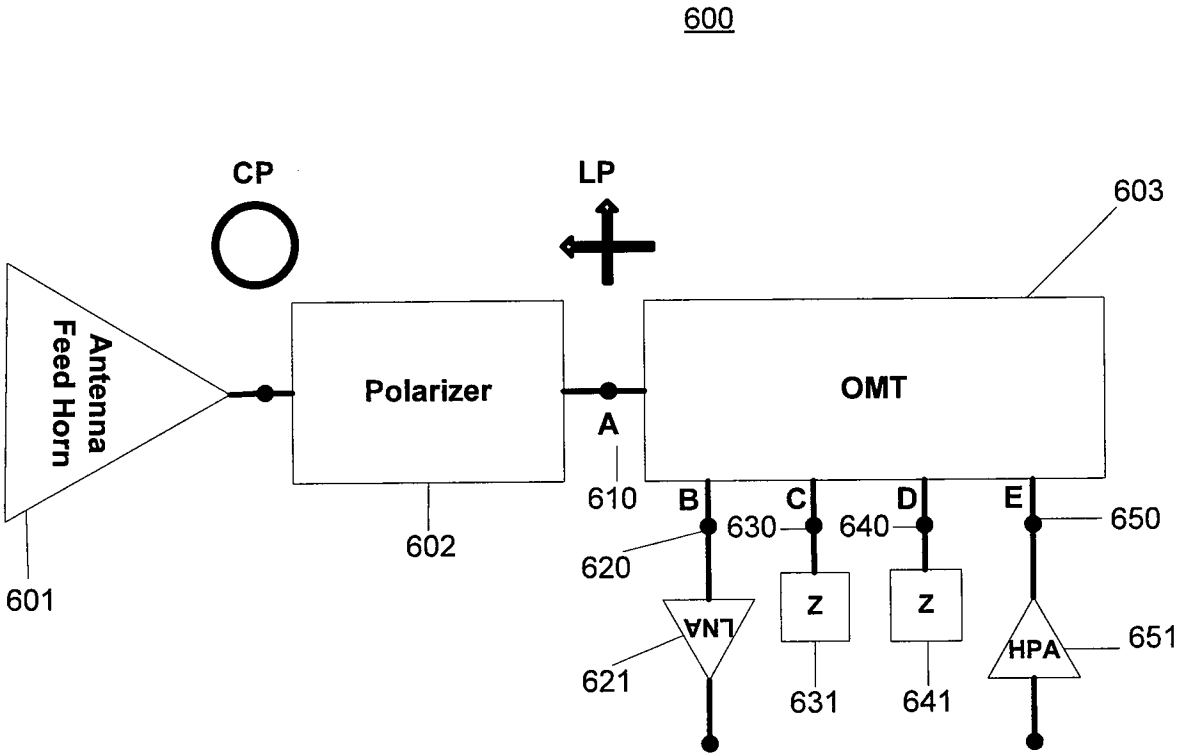
FIG. 6A illustrates, in a block diagram format, an exemplary embodiment of a feed subsystem.
Figure 6B:
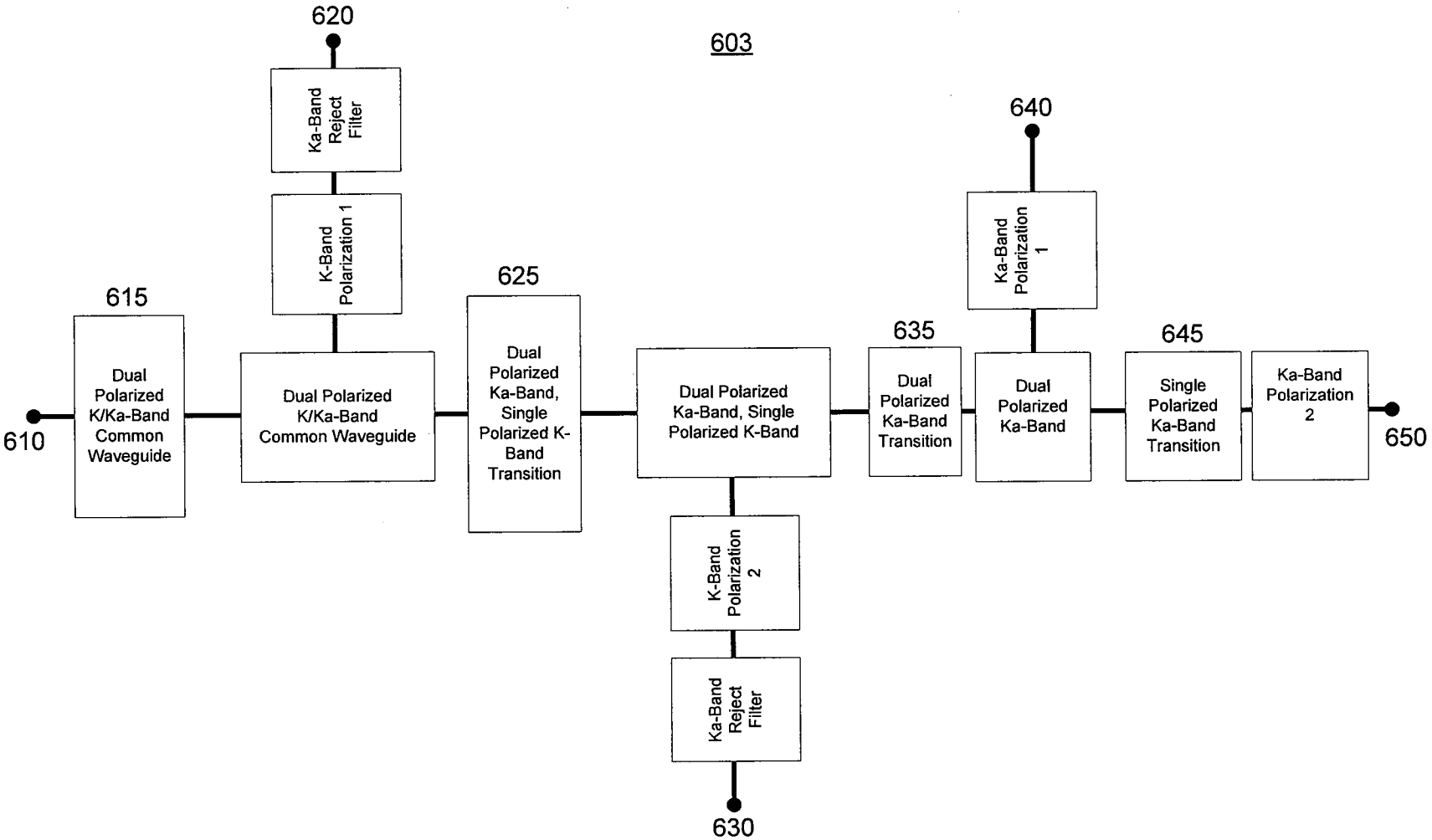
FIG. 6B illustrates, in a block diagram format, an exemplary embodiment of a dual-band four-port orthomode transducer.

In accordance with an exemplary embodiment and with reference to FIGS. 6A and 6B, a feed subsystem 600 comprises a dual-band four-port OMT 603 connecting to a dual-band circular polarizer 602, which connects to a feed horn 601 of a reflector antenna. In an exemplary embodiment, OMT 603 comprises a common port 610, a common waveguide 615, a first port 620 in communication with a low noise amplifier (LNA) 621, a second port 630 terminated into a matched load 631, a third port 640 terminated into another matched load 641, and a fourth port 650 in communication with a high power amplifier (HPA) 651. In another exemplary embodiment, the third port 640 and fourth port 650 may further comprise passband filters for the second frequency band segment for system performance considerations.

Similar to OMT 400, an alternate OMT design has a common port and four transmission ports. In an exemplary embodiment and with reference to FIGS. 7A and 7B, an in-plane dual-band four-port OMT 700 comprises a common port 710, a first signal channel 725, a second signal channel 735, a third signal channel 745, and a fourth signal channel 755. In another exemplary embodiment, in-plane OMT 700 further comprises a linear switch 760, which will be more fully described below. In an exemplary embodiment, in-plane OMT 700 further comprises five signal ports: a receive active port 711, a transmit active port 712, a receive termination port/load 713, a first transmit termination port/load 714, and a second transmit termination port/load 715. In an exemplary embodiment, linear switch 760 is configured to control the connection between signal channels 725, 735, 745, 755 and various of signal ports 711, 712, 713, 714, 715.

In accordance with an exemplary embodiment, linear switch 760 (sometimes referred to as a trumpet valve switch or sliding switch) is configured to facilitate switching polarization of the communicated signals in the system. In one embodiment, alternate signal channels are aligned with different polarization channels in in-plane OMT 700. For example, one pair of signal channels can align the antenna with RHCP, while another pair of signal channels can align the antenna with LHCP. By shifting the position of linear switch 760, the polarization of the antenna system is physically changed.

In order to shift linear switch 760, various switching mechanisms may be used. For example, the switching mechanism can include an inductor, an electro-magnet, a solenoid, a spring, a motor, an electro-mechanical device, or any combination thereof. Moreover, the switching mechanism can be any mechanism configured to move and maintain the position of linear switch 760. Furthermore, in an exemplary embodiment, linear switch 760 is held in position by a latching mechanism. The latching mechanism, for example, may be fixed magnets. The latching mechanism keeps linear switch 760 in place until the antenna is shifted to another polarization. In another exemplary embodiment, the switching mechanism is configured to be manually actuated.

Figure 7A:
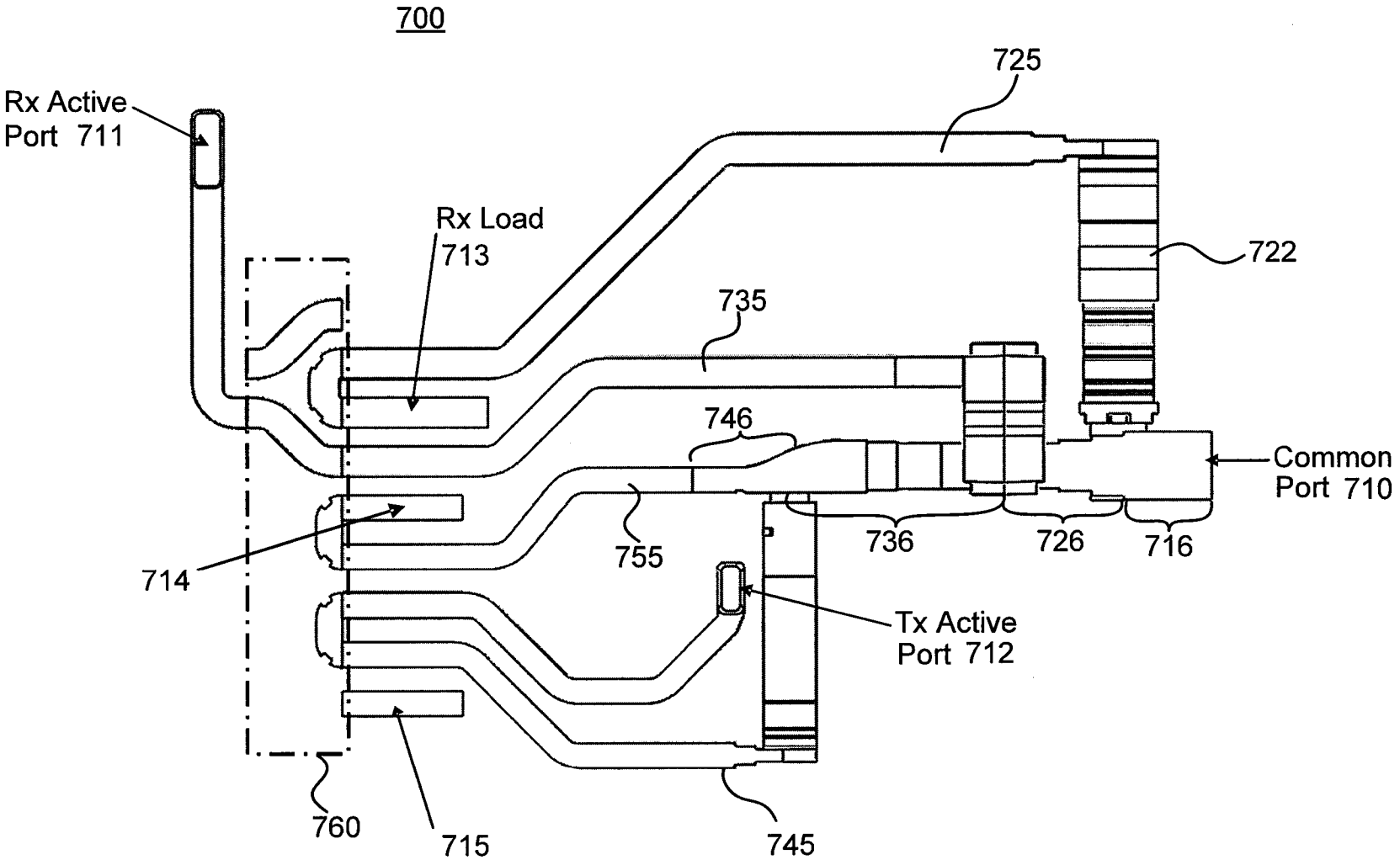
FIG. 7A illustrates an overhead view of an exemplary embodiment of an in-plane waveguide with a sliding switch in a first position.
Figure 7B:
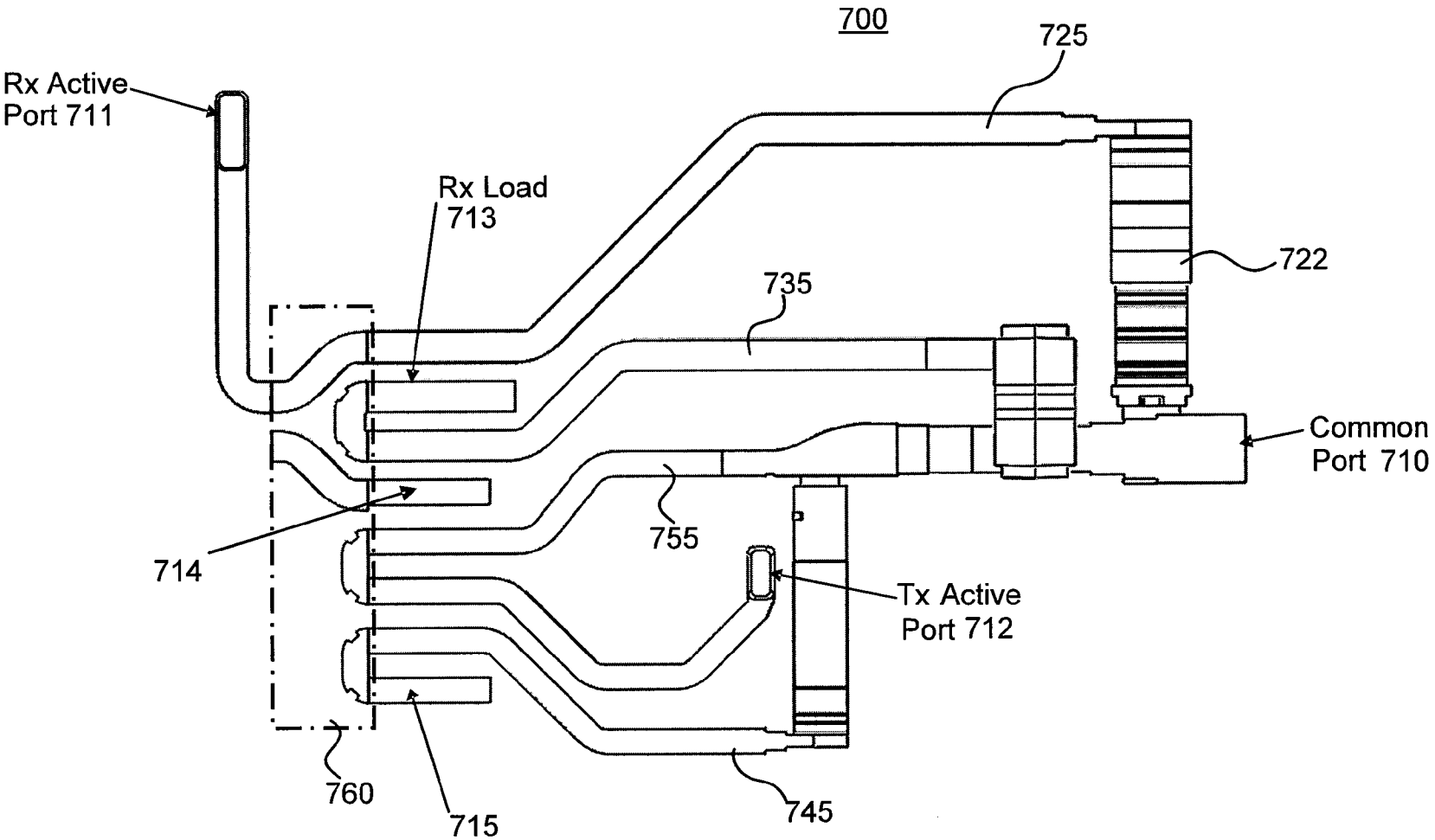
FIG. 7B illustrates an overhead view of an exemplary embodiment of an in-plane waveguide with a sliding switch in a second position.

In an exemplary embodiment, linear switch 760 has two positions, and the connections of the OMT channels and ports change with the position of linear switch 760, as illustrated in FIGS. 7A and 7B. For example, in the exemplary embodiment shown in FIG. 7A, first signal channel 725 terminates into receive termination port/load 713, while second signal channel 735 couples to receive active port 711. Similarly, third signal channel 745 connects to transmit active port 712, while fourth signal channel 755 terminates into first transmit port/load 714. In contrast, in the exemplary embodiment with the switch position changed as shown in FIG. 7B, the connections are changed. In this exemplary embodiment, first signal channel 725 connects to receive active port 711, while second signal channel 735 terminates into receive termination port/load 713. Similarly, third signal channel 745 terminates into second transmit port/load 715, while fourth signal channel 755 connects to transmit active port 712.

With continued reference to FIGS. 7A and 7B, OMT 700 further comprises a Ka-band reject waveguide filter 722 in first signal channel 725. The Ka-band reject filter reflects Ka-band signals that may exist at or near the junction of first signal channel 725 with the common waveguide channel. In another exemplary embodiment, a second Ka-band reject filter may be operatively located in second signal channel 735. The second Ka-band reject filter reflects Ka-band signals that may exist at or near the junction of second signal channel 735 with the common waveguide channel.

In an exemplary embodiment, third signal channel 745 or fourth signal channel 755 may further comprise filters. The filters can be added if the bands of operation of the respective waveguides sizes provide insufficient signal suppression of the first operational band. In another exemplary embodiment, in-plane OMT 700 is configured for three bands of operation. In a waveguide with three operation bands, third signal channel 745 or fourth signal channel 755 include filtering to suppress the signals of the third operational band. Furthermore, additional filtering at a fifth and sixth signal channel ports may be present if the respective waveguide sizes provide insufficient suppression of signals in the second operational band.

Although in-plane OMT 700 has channels that are substantially in the same plane, and the structure of the OMT is substantially flat, various other components are present. A substantially flat OMT has the majority of the signal channel ports arranged in the same plane of the common waveguide channel For example, the exemplary OMT 700 has three of the four signal channel ports arranged in the same plane of the common waveguide channel and is substantially flat. Notably, although the OMT is described as in-plane, the structure is a 3-dimensional structure having a length, width, and height.

Figure 8:
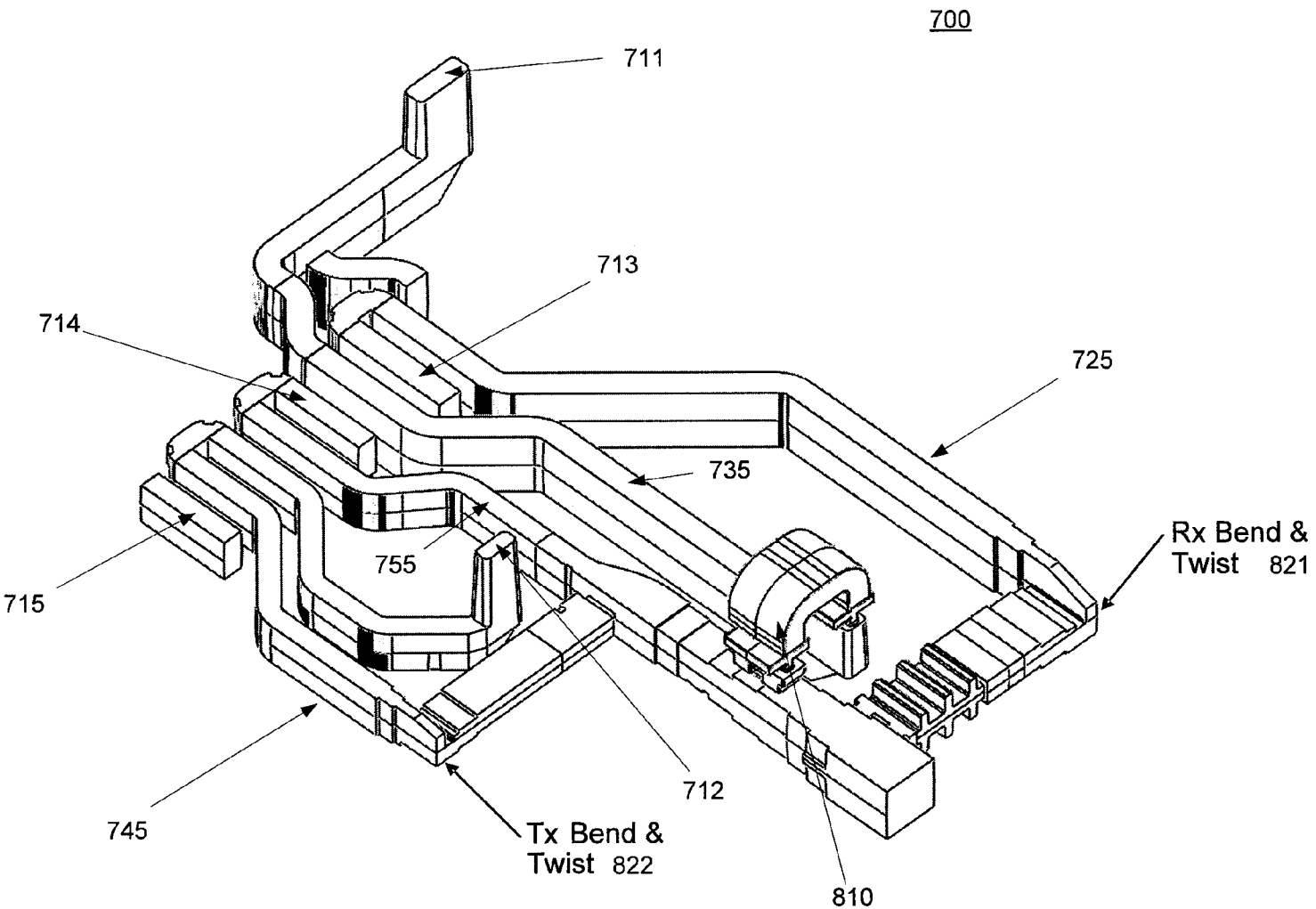
FIG. 8 illustrates a perspective view of an exemplary in-plane waveguide.

Furthermore, in an exemplary embodiment, in-plane OMT 700 further comprises a crossover component. With reference now to FIG. 8, an exemplary crossover component 810 connects a common channel of the OMT to second signal channel 735. In an exemplary embodiment, crossover component 810 is constructed of the same material as in-plane OMT 700. However, crossover component 810 may be constructed of any suitable material and using any suitable technique for communicating signals from the common channel of the OMT to second signal channel 735. Additionally, in an exemplary embodiment, crossover component 810 is attached to in-plane OMT 700 using at least one of fasteners, adhesive, solder, or any combination thereof. In another exemplary embodiment, crossover component 810 is attached to in-plane OMT 700 using any suitable means for forming a connection with low RF signal loss. Typically, crossover component 810 is C-shaped or U-shaped, depending on the distance between the interface waveguide channel ports. However, other shapes may be used, such as any shape suitable for connecting waveguide channels that are not in a common plane with the common port. Additionally, in an exemplary embodiment, crossover component 810 comprises filtering elements configured to increase an isolation quantity between signal ports of the waveguide system. The filtering elements may be located near one end of crossover component 810 or may be distributed along the length of the waveguide channel within crossover component 810.

With regard to changing signal direction, commonly known waveguide orientation transitions such as step-twists and continuous twists have been used. However, the step-twists and continuous twists cannot be manufactured in an integrated OMT assembly having only two parts that are individually cast or molded. An advantageous structure would be able to be separated into two parts and furthermore could be cast or molded.

Figure 9:
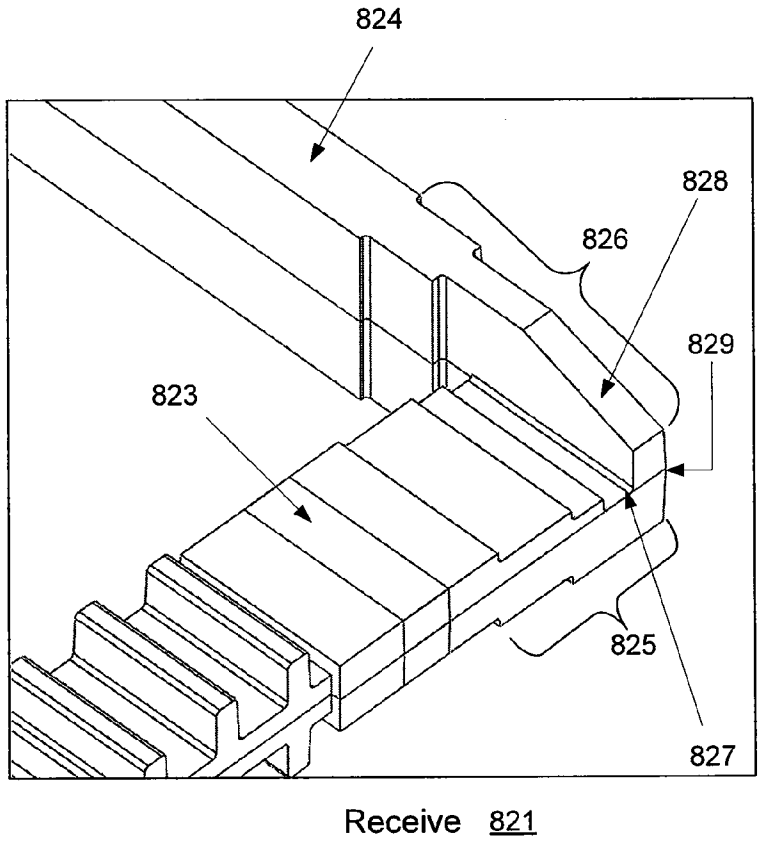
FIG. 9 illustrates two close-up views of exemplary "bend-twist" sections of an exemplary waveguide.
Figure 9:
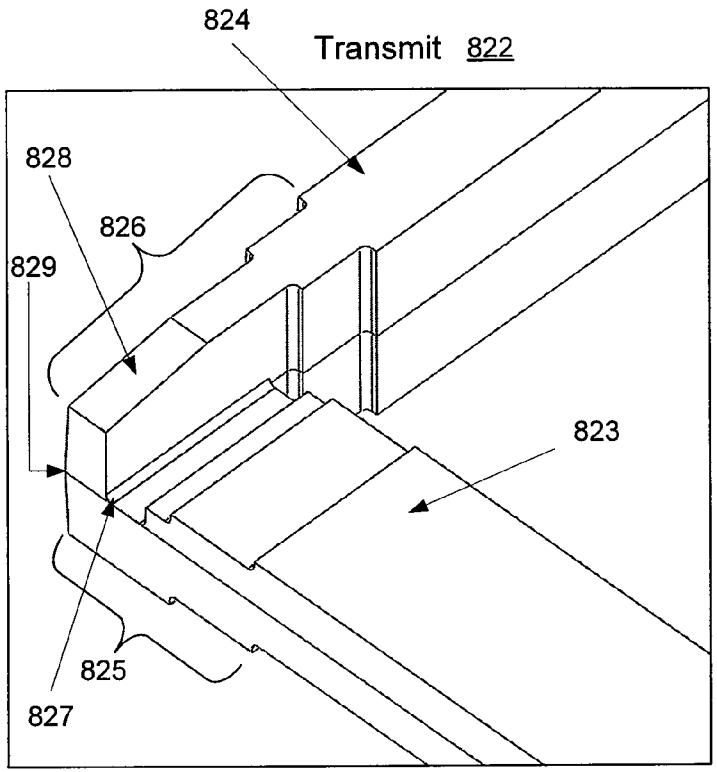

In accordance with an exemplary embodiment and with additional reference to FIG. 9, in-plane OMT 700 further comprises a "bend-twist" transition section in some of the signal channels. For example, first signal channel 725 may comprise a receive "bend-twist" section 821. Furthermore, in one embodiment, third signal channel 745 comprises a transmit "bend-twist" section 822. In an exemplary embodiment, bend-twist sections 821, 822 change the geometrical orientation of the electric field by 90 degrees and change the signal direction by 90 degrees. In an exemplary embodiment, bend-twist sections 821, 822 are transition regions for rotating the signal phase 90 degrees.

In accordance with an exemplary embodiment, bend-twist sections 821, 822 comprise a horizontal channel portion 823, a vertical channel portion 824, a horizontal transition portion 825, a vertical transition portion 826, and are bisected in the middle where the two split-block OMT portions connect at a joining line 829. In an exemplary embodiment, the bisecting plane of horizontal channel portion 823 and the bisecting plane of vertical channel portion 824 are the same plane. Furthermore, in an exemplary embodiment, the transition region is formed by progressively stepping down horizontal transition portion 825. The bottom portion of (also referred to as portion below) the bisecting line is increased while the top portion of (also referred to as portion above) the bisecting line is decreased until horizontal transition portion 825 is below, or substantially below, the bisecting line. The horizontal transition portion 825, with the signal path below the bisecting line, intersects and connects to vertical transition portion 826. In an exemplary embodiment, vertical transition portion 826 intersects horizontal transition portion 825 orthogonally with respect to the plane of the bisecting line, and also orthogonally at the plane of the bisecting line. To facilitate the polarization change of the signal, vertical transition portion 826 gradually increases the width towards vertical channel portion 824 in the bisecting plane.

In an exemplary embodiment, the bend-twist operation takes place at a single junction 827 that has transitions on both ends. Junction 827 includes a mitered wall 828 of the vertical transition portion 826 that is orthogonal to horizontal transition portion 825. The transitions on both sides of junction 827 are commonly known as E-plane steps. The E-plane steps of horizontal transition portion 825 move the centerline of horizontal transition portion 825 so the top of the waveguide is at or near the parting line of the two halves of the assembly. The E-plane steps of vertical transition portion 826 perform an impedance transformation from the impedance of vertical transition portion 826 at junction 827 to a higher impedance desired for signal transmission at a lower resistive (Ohmic) loss along the waveguide channel.

In an exemplary embodiment and with renewed reference to FIGS. 5A and 5B, transition areas in an OMT are configured to filter and separate various frequency band segments, such as high frequency from low frequency. Furthermore, the transition areas of OMT 400 and in-plane OMT 700 may each be configured to allow a selected polarization through the transition area but cut-off another polarization. For example, OMT 400 comprises transition areas 415, 425, 435, and 445. In an exemplary embodiment and with renewed reference to FIG. 7A, in-plane OMT 700 further comprises a common waveguide transition area 716, a first transition area 726, a second transition area 736, and a third transition area 746. In an exemplary embodiment, the transition areas are also configured to provide sufficient impedance matching and minimal reflection of the signals. In other words, the transition areas are configured to provide a low signal reflection loss. For example, if OMT 400 or in-plane OMT 700 transmits using a first frequency band and receives using a second frequency band, a transition area can facilitate separation of the first and second frequency bands so that the transmit and receive signals have little to no interference with one another.

More specifically, in an exemplary embodiment of OMT 400, first transition area 425 is configured to allow the bidirectional transmission of dual-polarized Ka-band signals and single polarized K-band signals. In another embodiment, second transition area 435 is configured to transition dual-polarized Ka-band signals. In other words, second transition area 435 is configured to allow bidirectional transmission of dual-polarized Ka-band signals. In yet another embodiment, third transition area 445 is configured to transition a single polarized Ka-band signal. In other words, third transition area 445 is configured to allow bidirectional transmission of single-polarized Ka-band signals.

Similarly, in an exemplary embodiment of in-plane OMT 700, first transition area 726 is configured to allow the bidirectional transmission of dual-polarized Ka-band signals and single polarized K-band signals. In another embodiment, second transition area 736 is configured to transition dual-polarized Ka-band signals. In other words, second transition area 736 is configured to allow bidirectional transmission of dual-polarized Ka-band signals. In yet another embodiment, third transition area 746 is configured to transition a single polarized Ka-band signal. In other words, third transition area 746 is configured to allow bidirectional transmission of single-polarized Ka-band signals.

In another exemplary embodiment, the distance between the third and second ports comprises a plurality of waveguide channel segments where each segment has a cross-section that is a different size than the adjacent cross-section. In an exemplary embodiment, the waveguide cross-section area at the distal end of second transition area 736 near the port to third signal channel 745 is larger than the cross-section area of second transition area 736 that is near the port to second signal channel 735. In other words, the cross-sectional area of second transition area 736 increases as the distance from common port 710 increases. For example, the cross-sections may get progressively larger the farther away from common port 710.

Additionally, in a specific exemplary embodiment of in-plane OMT 700, second transition area 736 is the longest of the transition areas. In an exemplary embodiment, the distance between the third and second ports is greater than one guide wavelength ($\lambda g$). In an exemplary embodiment, $\lambda g$ corresponds to the lowest frequency in the second frequency band segment. The longer transition area facilitates reducing reflections and avoiding higher order mode excitation. In an exemplary embodiment, a longer transition area also allows for a wider bandwidth and larger change in cross-sectional area at either end of the transition area.

In a specific embodiment of in-plane OMT 700 and as an example only, common waveguide transition area 716 has a length of 1.134 inch (2.88 cm). In an alternate embodiment, the distance between the third and second ports is greater than two guide wavelengths. The length of second transition area 736 and the relationship of the cross-sectional area near the port to third signal channel 745 being greater than the cross-sectional area near the port to second signal channel 735 are instrumental to achieving the frequency bandwidth of in-plane OMT 700. In a specific embodiment of in-plane 700 and as an example only, common waveguide transition area 716 has a length of 0.492 inch (1.250 cm) and first transition area 726 has a length of 0.611 inch (1.552 cm).

In an exemplary embodiment of in-plane OMT 700, the various communicated signals and corresponding channels adjoin the common channel of in-plane OMT 700 in a sequential order. In a specific exemplary embodiment, first signal channel 725 communicates an in-plane K-band receive signal having a first polarization, and second signal channel 735 communicates an out-of-plane K-band receive signal having a second polarization. Furthermore, in the specific embodiment, third signal channel 745 communicates an in-plane Ka-band transmit signal having the first polarization, and fourth signal channel 755 communicates an in-plane Ka-band transmit signal having the second polarization. As used herein, the plane of in-plane OMT 700 is the plane represented by the division of the split-block OMT. In other words, the two halves of the split-block OMT connect to form the OMT, and the edge formed at the connection is defined as the plane of the in-plane OMT 700.

In an exemplary embodiment, the first polarization of the signals communicated through first and third signal channels 725, 745 is vertical linear, and the second polarization of the signals communicated through second and fourth signal channels 735, 755 is horizontal linear, or vice versa. Furthermore, the first polarization may be RHCP while the second polarization is LHCP, or vice versa.

In an exemplary embodiment, the OMT is a dual-band device having two distinct and separate frequency bands or ranges of operation. The bands or ranges of frequencies are frequency band segments. Furthermore, there is a range of frequencies between the frequency band segments where the performance characteristics of the OMT may degrade. In an exemplary embodiment, two waveguide ports correspond to radio frequency (RF) signal paths that guide signals with relatively low loss transmission characteristics for a first frequency band segment. In the exemplary embodiment, the other two waveguide ports support relatively low loss signal transmission for a second frequency band segment. The second frequency band segment is operationally a higher range of frequency values and correspondingly supports a smaller signal wavelength when compared to the first frequency band segment.

The common port of the OMT supports low loss signal transmission for both the first and second band segments. In a first embodiment, the first band segment is in the K-band which is a frequency range of about 18.3 to 20.2 GHz, resulting in a bandwidth of approximately 1900 MHz. The second band segment is the Ka-band which is a frequency range of about 28.1 to 30.0 GHz, resulting in a bandwidth of approximately 1900 MHz. These operational band segments are alternatively known as operational passbands. Moreover, a dual-band device operating over these two exemplary frequency ranges is also known as a K/Ka-Band device.

In a second embodiment, the first band segment can be K-band and the second band segment is the Q-band which is a frequency range of about 43.5 to 45.5 GHz, typically for military communications. In this embodiment, the K-band may be a frequency range of about 20.2 to 21.2 GHz. Furthermore, in a third exemplary embodiment a first band segment may be K-band, a second band segment may be Ka-band, and a third band segment may be Q-Band. Here it is understood that two additional ports are necessary to support the third frequency band of operation.

In accordance with the exemplary embodiment, the OMT structure is configured to support low loss signal transmission in the interband segment and may have degraded performance. The interband segment is the frequency range between the operational band segments or passbands. For example, in the K/Ka-Band device briefly described above, the interband segment is the frequency range of 20.2 GHz to 28.1 GHz. In an exemplary embodiment, the OMT may be designed such that portions of the OMT other than the common port region between the first port of the first frequency band and the common port have degraded performance for one or both signal polarizations for the interband segment.

In accordance with an exemplary embodiment and with renewed reference to FIGS. 6A and 6B, common port 610 supports bi-directional low loss signal transmission for a first frequency band segment and a second frequency band segment. In an exemplary embodiment, the first frequency band segment corresponds to receive signals on a forward link from a satellite and the second frequency band segment corresponds to transmit signals on a return link to a satellite. In an exemplary embodiment, the second frequency band segment has higher frequency values and correspondingly has smaller wavelength than the first frequency band segment. For example, the first frequency band segment may be a K-band operational set of frequencies and the second frequency band segment may be a Ka-band operational set of frequencies.

The first port 620 corresponds to a first polarization state or circular polarization sense of a first frequency band segment of feed system 600. In an exemplary embodiment, the first port 620 is adjacent to common port 610. Stated another way, in an exemplary embodiment, first port 620 bisects a center axis of common port 610 such that first port 620 has the shortest relative distance to common port 610 in comparison to the other ports. Furthermore, first port 620 is configured to receive a signal on the forward link from a satellite. In addition, a waveguide channel between common port 610 and the filter associated with first port 620 is configured to support bi-directional low loss signal transmission of two orthogonal polarizations for both the first and second frequency band segments. First port 620 further comprises a waveguide channel filter configured to reject or reflect signals in the second frequency band segment.

The second port 630 corresponds to a second polarization state of the first frequency band segment, which is orthogonal to the first polarization state associated with first port 620. In an exemplary embodiment, second port 630 is adjacent to first port 620 along a common channel. A waveguide channel 625, which is a portion of the common channel between the junction of first port 620 and the junction second port 630, is configured to support bi-directional low loss signal transmission of the second polarization state of the first frequency band segment and low loss signal transmission of both orthogonal polarizations of the second frequency band segment. The second port 630 may further include a waveguide channel filter configured to reject or reflect signals in the second frequency band segment. The matched load is configured to effectively terminate any signals cross-polarized to the first polarization state in the receive frequency band. In an exemplary embodiment, the receive frequency band corresponds to the first frequency band segment. In an exemplary embodiment, OMT 603 is operated in conjunction with dual-band circular polarizer 602 and improves the circular polarization quality of the first polarization state by terminating unwanted signals in the second polarization state.

The third port 640 corresponds to a second polarization state or circular polarization sense of the feed system. Furthermore, third port 640 is configured to transmit a signal on the return link to a satellite. In an exemplary embodiment, third port 640 corresponds to a first polarization state of the second frequency band segment and is co-polarized with first port 620 of the first frequency band segment. Furthermore, in an exemplary embodiment, third port 640 is adjacent to second port 630 along the common channel. A waveguide channel 635 between the filter associated with second port 630 and the filter associated with third port 640 is configured to support low loss signal transmission of both orthogonal polarizations of the second frequency band segment but is not configured to support low loss signal transmission of the first frequency band segment. In an exemplary embodiment, the size of waveguide channel 635 and associated third port 640 sufficiently suppress the propagation of signals in the first band segment resulting in a port filter being unnecessary.

The fourth port 650 corresponds to a second polarization state of the second frequency band segment, which is orthogonal to the polarization associated with third port 640. Moreover, in an exemplary embodiment, the second polarization state of the second frequency band segment is orthogonal to the polarization of first port 620. In an exemplary embodiment, fourth port 650 is adjacent to third port 640 along the common channel. A waveguide channel 645 between the junction of third port 640 and the junction of fourth port 650 is configured to support bi-directional low loss signal transmission of the second polarization state of the second frequency band, but is not configured to support low loss signal transmission of the first polarization of the second frequency band segment. In an exemplary embodiment, the matched load in communication with the third port 640 is configured to effectively terminate any signals cross-polarized to the second polarization state in the transmit frequency band. In an exemplary embodiment, the transmit frequency band corresponds to the second frequency band segment. Moreover, in the exemplary embodiment, the receive polarization state of feed subsystem 600 is orthogonally polarized to the transmit polarization state.

In the exemplary embodiment, the OMT is differentiated from a turnstile junction OMT, which is one class of OMT where a turnstile junction has the four ports aligned at the same position along the axis of the common port. The exemplary OMT embodiment as illustrated by FIGS. 4, 5A and 5B is advantageous over the turnstile junction in that a mode forming or power combining of the individual port signals is not necessary and further diplexing filters are not necessary in order to separate frequency band segments for interfacing to transmit and receive signal paths. The exemplary OMT embodiment is also differentiated from another class of OMT where the two ports separating the orthogonal polarization components for a frequency band segment are substantially aligned at the same position along the axis of the common port. The exemplary OMT embodiment has the two ports separating the orthogonal components for a band segment spaced apart along the waveguide channel of common port 610. For example, first port 620 and second port 630 are spaced apart along the waveguide channel and have waveguide channel 625 in between first port 620 and second port 630. Moreover, third port 640 and fourth port 650 are spaced apart along the waveguide channel and have waveguide channel 645 in between third port 640 and fourth port 650. In an exemplary embodiment, the transition areas support low loss transmission of only one of the polarizations of the corresponding frequency band segment. This layout or arrangement may be advantageous in designing for wide bandwidth performance for either the first or second band segment. Furthermore, the layout provides for additional degrees of freedom and independent features in the structure for orthogonal polarization mode launching and impedance matching of the individual ports and transitions between sections. In other words, the exemplary OMT embodiment is configured to incorporate greater independence in the design of the individual polarization mode ports of dual-band OMT 603 than other known types of OMTs.

Figures 10A, 10B:
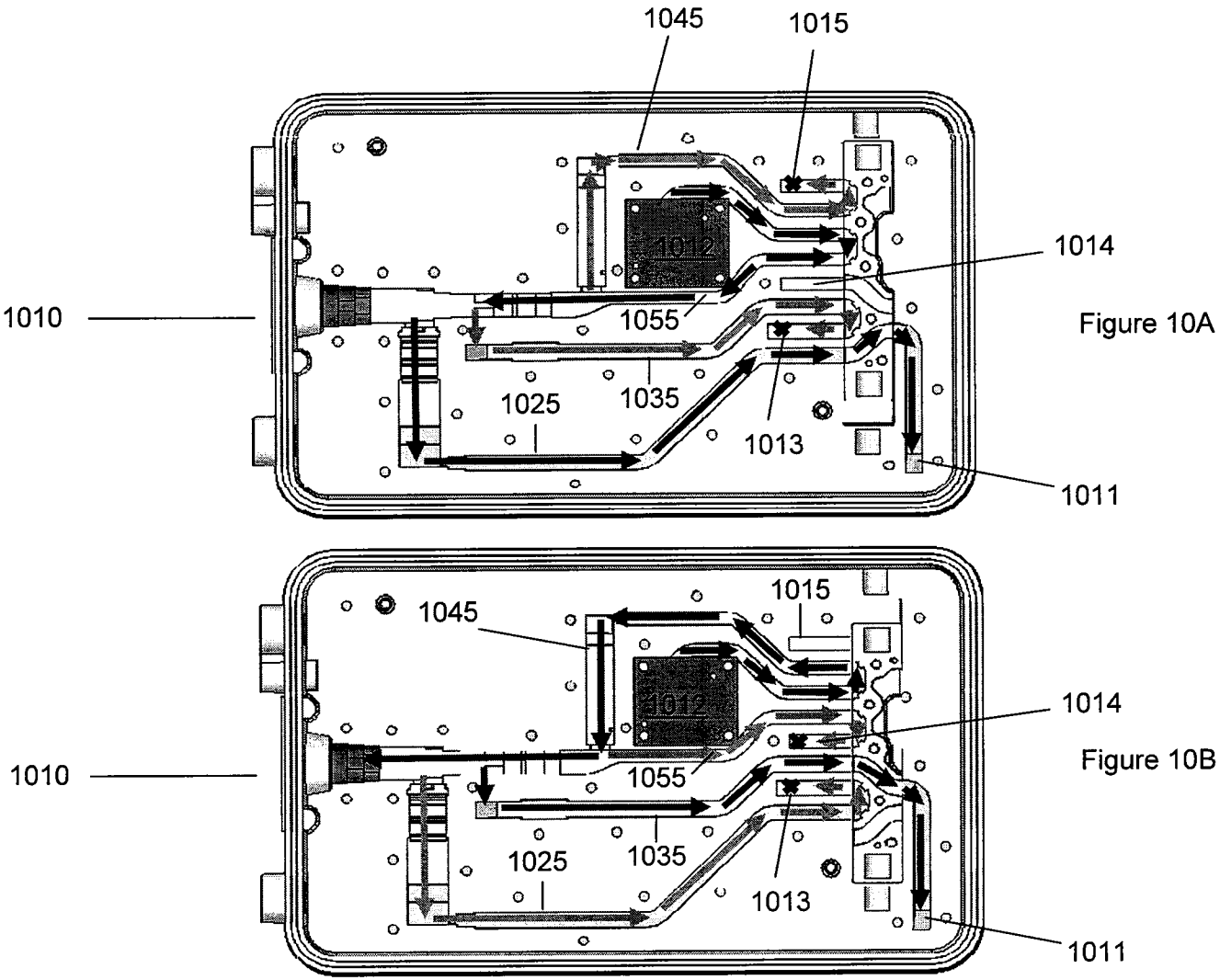
FIGS. 10A and 10B illustrate an exemplary antenna system with alternate signal paths due to polarization switching.

In accordance with an exemplary embodiment, FIG. 10A illustrates the signal channels if sliding switch 1004 is in one position, and FIG. 10B illustrates the signal channels if linear switch 1004 (also referred to as a sliding switch) is in another position. In the exemplary configuration illustrated by FIG. 10A, first signal channel 1025 is connected to receive active port 1011, second signal channel 1035 is terminated into receive termination port/load 1013, third signal channel 1045 is terminated into second termination port/load 1015, and fourth signal channel 1055 is connected to transmit active port 1012. In contrast, in the exemplary configuration illustrated by FIG. 10B, first signal channel 1025 is terminated into receive termination port/load 1013, second signal channel 1035 is connected to receive active port 1011, third signal channel 1045 is connected to transmit active port 1012, and fourth signal channel 1055 is terminated into first termination port/load 1014.

In accordance with an exemplary embodiment, sliding switch 1004 is made of metalized plastic. Metalized plastic is lighter weight and less expensive than metal. Furthermore, a lighter weight sliding switch needs less force to change position. In an exemplary embodiment, the waveguide portions present in sliding switch 1004 are short and thus result in minimal RF loss. In one embodiment, the waveguide portions of sliding switch 1004 do not include additional features. However, in exemplary embodiments the short waveguide portions in sliding switch 1004 may include RF loads, filters, or impedance matching structures. This can result in increased antenna performance and additional compactness of the waveguide.

The position of sliding switch 1004, in an exemplary embodiment, is controlled by a microcontroller. As previously discussed, the microcontroller can receive instructions from a variety of sources, including a central controller, local computer, a modem, or a local switch. Furthermore, various other devices and methods of controlling sliding switch 1004 may be implemented as would be known to one skilled in the art.

Figure 11:
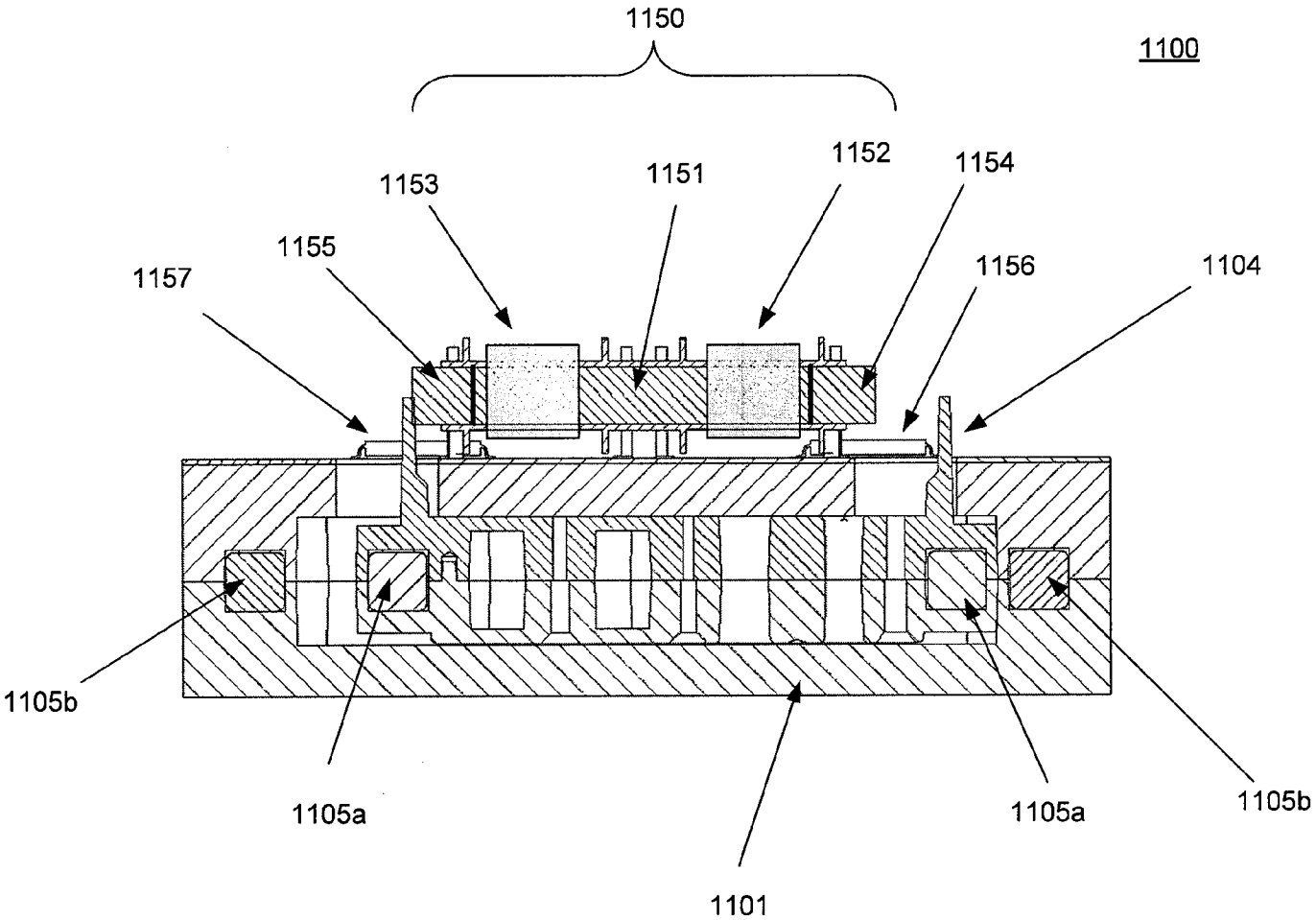
FIG. 11 illustrates a cross-sectional view of an exemplary antenna system with sliding switch and switching mechanism.

In accordance with an exemplary embodiment and with reference to FIG. 11, an antenna system 1100 comprises a transceiver housing 1101 having a waveguide 1103. In an exemplary embodiment, waveguide 1103 is integrated into a transceiver housing 1101. In another embodiment, waveguide 1103 is part of a structure that is "dropped in" to transceiver housing 1101. Transceiver housing 1101 further comprises a sliding switch 1104. In an exemplary embodiment, switching mechanisms are configured to change sliding switch 1104 between two different polarizations. In order to shift sliding switch 1104, various switching mechanisms may be used. For example, the switching mechanism can include an inductor, an electro-magnet, a solenoid, a spring, a motor, an electro-mechanical device, or any combination thereof. Moreover, the switching mechanism can be any mechanism configured to move the position of sliding switch 1104.

Furthermore, in an exemplary embodiment, sliding switch 1104 is held in position by a latching mechanism 1105. The latching mechanism 1105, for example, may be fixed magnets 1105*a* and metal inserts 1105*b* to attach to the magnets. The latching mechanism 1105 keeps sliding switch 1104 in place until the antenna is commanded to another polarization.

In an exemplary embodiment, a solenoid 1150 is the switching mechanism used to move sliding switch 1104 in a linear path. Solenoid 1150 may be made of surface mount inductors. Furthermore, in an exemplary embodiment, solenoid 1150 comprises a plunger 1151, a first coil 1152, a second coil 1153, a first standoff 1154 connected to a first end of plunger 1151, and a second standoff 1155 connected to a second end of plunger 1151 opposite the first end. In another exemplary embodiment, antenna system 1100 further comprises proximity detectors 1156, 1157.

In an exemplary embodiment, plunger 1151 is made of a ferromagnetic alloy and standoffs 1154, 1155 are non-magnetic. In one embodiment, non-magnetic standoffs 1154, 1155 are made of aluminum. The non-magnetic standoffs allow for additional force to be applied to the plunger. In an exemplary embodiment, solenoid 1150 provides peak force at the moment that it attempts to disengage from one of latching mechanisms 1105. The distance that plunger 1151 moves contains regions of higher and lower magnetic force, so an exemplary design optimizes the length of travel and length of plunger 1151 to take advantage of the region of highest magnetic force. This allows smaller electromagnets to move the same amount of mass and lower current to be used in the electromagnet during switching. Plunger 1151 can then push the slider's tabs into either position.

In another exemplary embodiment, proximity detectors 1156, 1157 enable the system to determine the current polarization based on the position of sliding switch 1104. As an example, the proximity detectors may be magnetic such as a reed switch, electrical such as a contact switch, or an optical sensor. Furthermore, in one embodiment only a single proximity detector is implemented. In addition, other various proximity detector methods may be used as would be known to one skilled in the art. In an exemplary embodiment, the detected position of the sliding switch indicates the current routing of the waveguide by correlating the detected position to the current polarization of the waveguide.

Figure 12A:
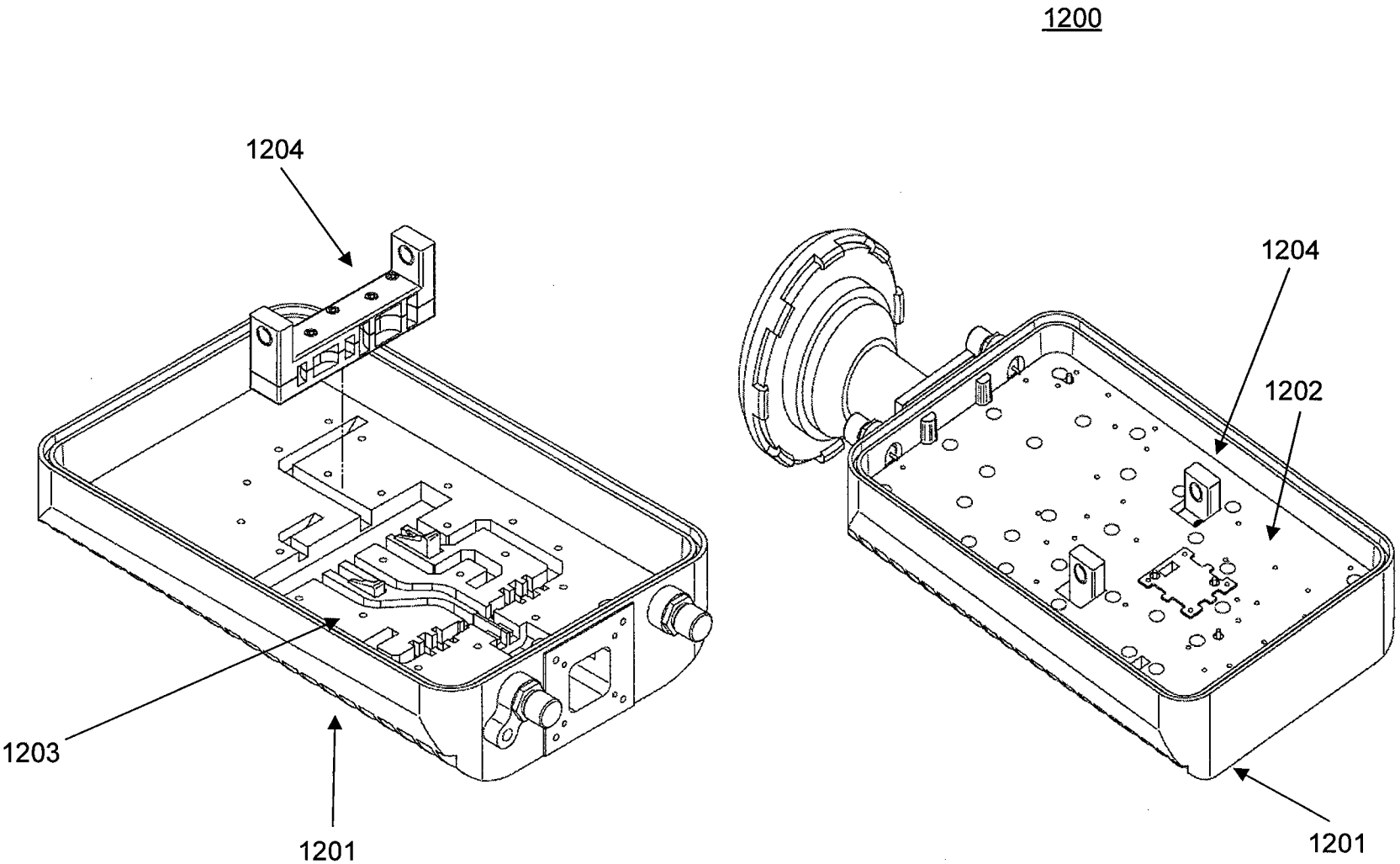
FIG. 12A illustrates another exemplary antenna system with a sliding switch for facilitating polarization switching.
Figure 12B:
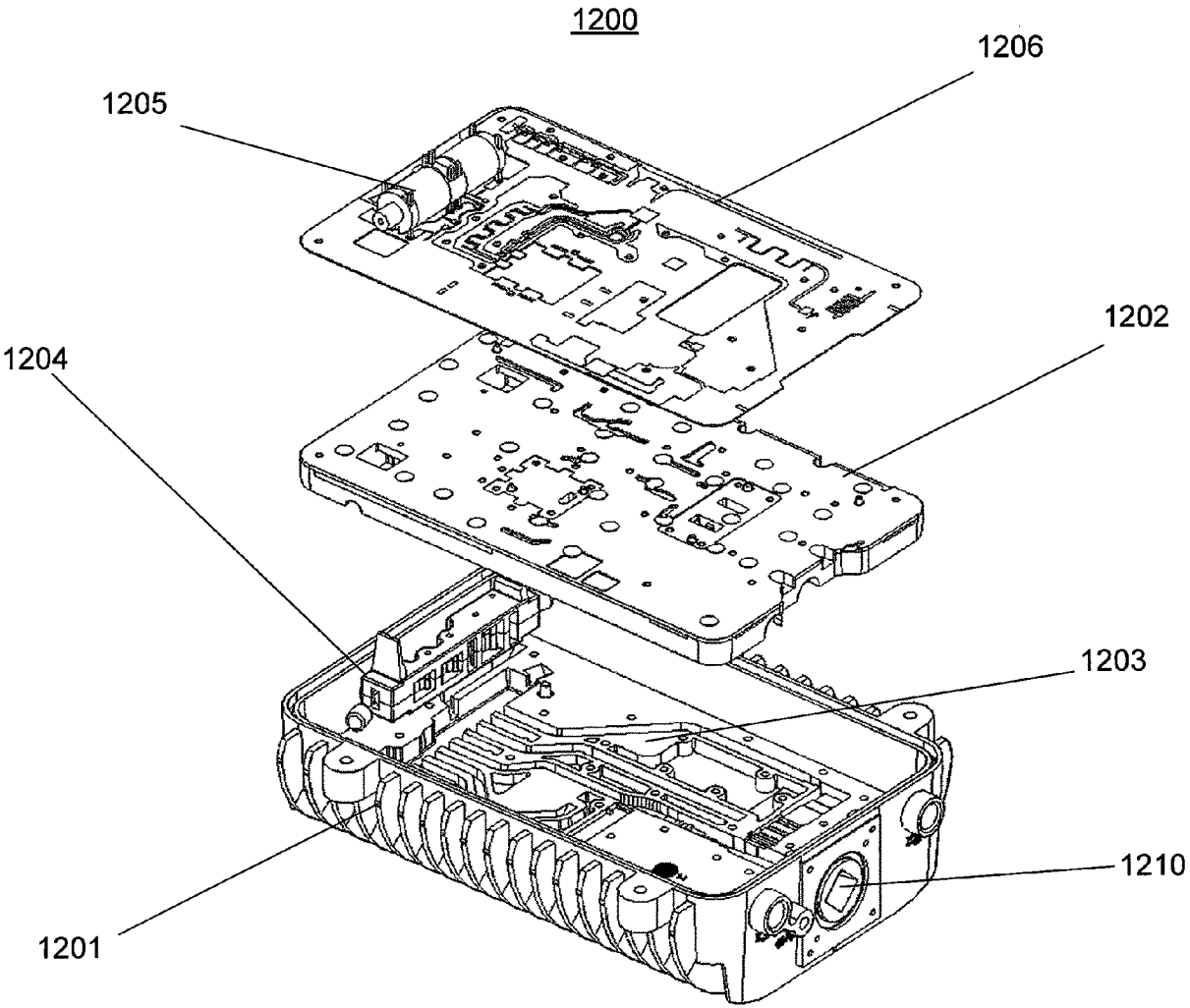
FIG. 12B illustrates an exploded view of an exemplary antenna system with a sliding switch.

In an exemplary embodiment and with reference to FIGS. 12A and 12B, an exemplary antenna system 1200 comprises a housing 1201, a waveguide 1203, and a sliding switch 1204. Antenna system 1200 may further comprise a sub-floor component 1202, a printed circuit board 1206, and a switching mechanism 1205. In one exemplary embodiment, waveguide 1203 is formed as part of housing 1201.

In this exemplary embodiment, sliding switch 1204 is placed in a recess in housing 1201. Furthermore, sub-floor component 1202 is placed within housing 1201 and is configured to cover, and enclose, waveguides 1203 as well as sandwiching at least a portion of sliding switch 1204. In one embodiment, printed circuit board 1206 is located on top of sub-floor 1202. In another embodiment, switching mechanism 1205 is located on printed wiring board 1206.

In one embodiment, housing 1201 comprises the outer structure of antenna system 1200. Furthermore, in an exemplary embodiment, housing 1201 comprises port of waveguide 1203, which includes multiple waveguide channels. In an exemplary embodiment, some of waveguide channels are connected to a common port 1210. In one exemplary embodiment, the waveguide paths are integrated into the interior of housing 1201. In another exemplary embodiment, the waveguide paths 1203 are part of a "drop in" component that inserts into housing 1201.

In an exemplary embodiment, housing 1201, or alternatively the drop-in component, is formed with a recess configured to receive sliding switch 1204. This recess may be large enough to facilitate alignment of sliding switch 1204 with the appropriate waveguide paths and to facilitate sliding from at least a first position to second position. Additionally, sliding switch 1204 may be retained within the recess by sub-floor component 1202. Sub-floor component is configured to be placed over at least a portion of the interior surface of housing 1201. Alternatively, sub-floor component 1202 may be the other half of a drop in component. In an exemplary embodiment, sub-floor component 1220 is configured to complete the waveguide paths by forming a top portion of those waveguide paths. Sub-floor component 1220 may also be configured to provide openings for a portion of sliding switch 1204 to extend far enough for interaction with switching mechanism 1205.

In another exemplary embodiment, antenna system 1200 further comprises a switching mechanism 1205 mounted on a printed circuit board 1206. The integrated waveguide 1203 and connected sliding switch 1204 are inside housing 1201. This facilitates a more compact system and increases protection of components from weather. In this manner, sliding switch 1204 is capable of a longer useful life. For example, there is more protection against dirt and other material from entering and disrupting switching mechanism 1205.

In an exemplary embodiment, waveguide 1203 (typically an OMT) is formed inside the antenna system housing 1201 and a sub-floor component 1202. Neither housing 1201 nor sub-floor component 1202 alone is configured to operate as a waveguide. In an exemplary embodiment, a portion of the waveguide is cast into housing 1201 and is part of the system housing 1201.

In an exemplary embodiment, a polarizer and feed horn are still external to the antenna system housing. In another exemplary embodiment, the feed horn is external to the housing and the polarizer is also integrated into the system housing. In yet another exemplary embodiment, both the feed horn and the polarizer are located in the antenna system housing, along with waveguide 1203 and sliding switch 1204. For additional detail regarding an integrated waveguide, please see U.S. patent application Ser. No. 12/268,840, entitled "Integrated OMT", which was filed on Nov. 11, 2008, which is herein incorporated by reference.

Although sliding switch 1204 has a linear motion in the exemplary embodiments as discussed above, in accordance with another exemplary embodiment a rotary motion switch may also be implemented. It is noted that the physical rotation may occur either inside or outside the housing of the antenna system. Furthermore, the physical rotation is relative motion between the antenna feed and the transceiver. In other words, either at least a portion of the antenna feed, or the transceiver housing may rotate. In an exemplary embodiment, an antenna system comprises a housing, a waveguide integrated into the housing, a polarizer in communication with the waveguide and connected to the housing, and a feed horn connected to the polarizer. In an exemplary embodiment, the polarizer comprises a gear and the antenna system further comprises a gear motor. The polarizer is rotated about a central axis using the gear and gear motor. In one embodiment, a signal is delivered to the antenna system and controls the gear motor rotating the polarizer via the gear.

Furthermore, the described invention is not limited to switching between two different polarizations. In an exemplary embodiment, an antenna system is configured to switch between three or more polarizations. The antenna system may include more than one sliding switch. Additionally, in an exemplary embodiment, a sliding switch is designed to shift vertically and horizontally with respect to the waveguide. The additional movement can be used to incorporate additional waveguide routing, and thus additional polarizations.

4 Color System

In spot beam communication satellite systems both frequency and polarization diversity are utilized to reduce interference from adjacent spot beams. In an exemplary embodiment, both frequencies and polarizations are re-used in other beams that are geographically separated to maximize communications traffic capacity. The spot beam patterns are generally identified on a map using different colors to identify the combination of frequency and polarity used in that spot beam. The frequency and polarity re-use pattern is then defined by how many different combinations (or "colors") are used.

In accordance with various exemplary embodiments, an antenna system is configured for frequency and polarization switching. In one specific exemplary embodiment, the frequency and polarization switching comprises switching between two frequency ranges and between two different polarizations. This may be known as four color switching. In other exemplary embodiments, the frequency and polarization switching comprises switching between three frequency ranges and between two different polarizations, for a total of six separate colors. Furthermore, in various exemplary embodiments, the frequency and polarization switching may comprise switching between two polarizations with any suitable number of frequency ranges. In another exemplary embodiment, the frequency and polarization switching may comprise switching between more than two polarizations with any suitable number of frequency ranges.

In accordance with various exemplary embodiments, the ability to perform frequency and polarization switching has many benefits in terrestrial microwave communications terminals. Terrestrial microwave communications terminals, in one exemplary embodiment, comprise point to point terminals. In another exemplary embodiment, terrestrial microwave communications terminals comprise ground terminals for use in communication with a satellite. These terrestrial microwave communications terminals are spot beam based systems.

Prior art spot beam based systems use frequency and polarization diversity to reduce or eliminate interference from adjacent spot beams. This allows frequency reuse in non-adjacent beams resulting in increased satellite capacity and throughput. Unfortunately, in the prior art, in order to have such diversity, installers of such systems must be able to set the correct polarity at installation or carry different polarity versions of the terminal. For example, at an installation site, an installer might carry a first terminal configured for left hand polarization and a second terminal configured for right hand polarization and use the first terminal in one geographic area and the second terminal in another geographic area. Alternatively, the installer might be able to disassemble and reassemble a terminal to switch it from one polarization to another polarization. This might be done, for example, by removing the polarizer, rotating it 90 degrees, and reinstalling the polarizer in this new orientation. These prior art solutions are cumbersome in that it is not desirable to have to carry a variety of components at the installation site. Also, the manual disassembly/reassembly steps introduce the possibility of human error and/or defects.

These prior art solutions, moreover, for all practical purposes, permanently set the frequency range and polarization for a particular terminal. This is so because any change to the frequency range and polarization will involve the time and expense of a service call. An installer would have to visit the physical location and change the polarization either by using the disassembly/re-assembly technique or by just switching out the entire terminal. In the consumer broadband satellite terminal market, the cost of the service call can exceed the cost of the equipment and in general manually changing polarity in such terminals is economically unfeasible.

In accordance with various exemplary embodiments, a low cost system and method for electronically or electro-mechanically switching frequency ranges and/or polarity is provided. In an exemplary embodiment, the frequency range and/or polarization of a terminal can be changed without a human touching the terminal. Stated another way, the frequency range and/or polarization of a terminal can be changed without a service call. In an exemplary embodiment, the system is configured to remotely cause the frequency range and/or polarity of the terminal to change.

In one exemplary embodiment, the system and method facilitate installing a single type of terminal that is capable of being electronically set to a desired frequency range from among two or more frequency ranges. Some exemplary frequency ranges include receiving 10.7 GHz to 12.75 GHz, transmitting 13.75 GHz to 14.5 GHz, receiving 18.3 GHz to 20.2 GHz, and transmitting 28.1 GHz to 30.0 GHz. Furthermore, other desired frequency ranges of a point-to-point system fall within 15 GHz to 38 GHz. In another exemplary embodiment, the system and method facilitate installing a single type of terminal that is capable of being electronically set to a desired polarity from among two or more polarities. The polarities may comprise, for example, left hand circular, right hand circular, vertical linear, horizontal linear, or any other orthogonal polarization. Moreover, in various exemplary embodiments, a single type of terminal may be installed that is capable of electronically selecting both the frequency range and the polarity of the terminal from among choices of frequency range and polarity, respectively.

In an exemplary embodiment, transmit and receive signals are paired so that a common switching mechanism switches both signals simultaneously. For example, one "color" may be a receive signal in the frequency range of 19.7 GHz to 20.2 GHz using RHCP, and a transmit signal in the frequency range of 29.5 GHz to 30.0 GHz using LHCP. Another "color" may use the same frequency ranges but transmit using RHCP and receive using LHCP. Accordingly, in an exemplary embodiment, transmit and receive signals are operated at opposite polarizations. However, in some exemplary embodiments, transmit and receive signals are operated on the same polarization which increases the signal isolation requirements for self-interference free operation.

Thus, a single terminal type may be installed that can be configured in a first manner for a first geographical area and in a second manner for a second geographical area that is different from the first area.

In accordance with an exemplary embodiment, a terrestrial microwave communications terminal is configured to facilitate load balancing. Load balancing involves moving some of the load on a particular satellite, or point-to-point system, from one polarity/frequency range "color" or "beam" to another. The load balancing is enabled by the ability to remotely switch frequency range and/or polarity.

Thus, in exemplary embodiments, a method of load balancing comprises the steps of remotely switching frequency range and/or polarity of one or more terrestrial microwave communications terminals. For example, system operators or load monitoring computers may determine that dynamic changes in system bandwidth resources has created a situation where it would be advantageous to move certain users to adjacent beams that may be less congested. In one example, those users may be moved back at a later time as the loading changes again. In an exemplary embodiment, this signal switching (and therefore this satellite capacity "load balancing") can be performed periodically. In other exemplary embodiments, load balancing can be performed on many terminals (e.g., hundreds or thousands of terminals) simultaneously or substantially simultaneously. In other exemplary embodiments, load balancing can be performed on many terminals without the need for thousands of user terminals to be manually reconfigured.

In an exemplary embodiment, the load balancing is performed as frequently as necessary based on system loading. For example, load balancing could be done on a seasonal basis. For example, loads may change significantly when schools, colleges, and the like start and end their sessions. As another example, vacation seasons may give rise to significant load variations. In another example, load balancing is performed on an hourly basis. Furthermore, load balancing could be performed at any suitable time. In one example, if maximum usage is between 6-7 PM then some of the users in the heaviest loaded beam areas could be switched to adjacent beams in a different time zone. In another example, if a geographic area comprises both office and home terminals, and the office terminals experience heaviest loads at different times than the home terminals. In yet another embodiment, a particular area may have increased localized traffic, such as during a sporting event or a convention.

In an exemplary embodiment, the switching may occur with any regularity. For example, the polarization may be switched during the evening hours, and then switched back during business hours to reflect transmission load variations that occur over time. In an exemplary embodiment, the polarization may be switched thousands of times during the life of the device.

Figure 13:
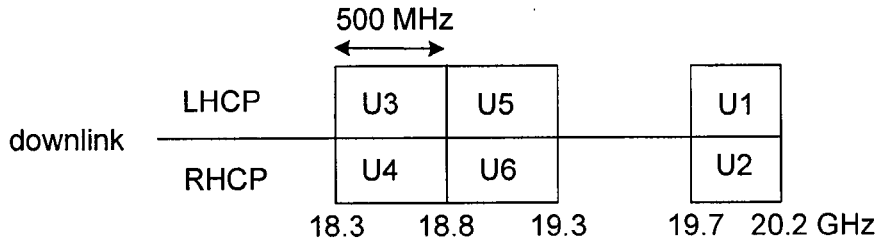
FIG. 13 illustrates an exemplary embodiment of color distribution.
Figure 13:
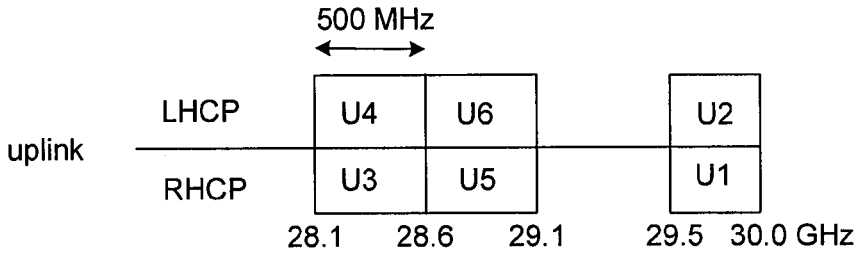
Figure 13:
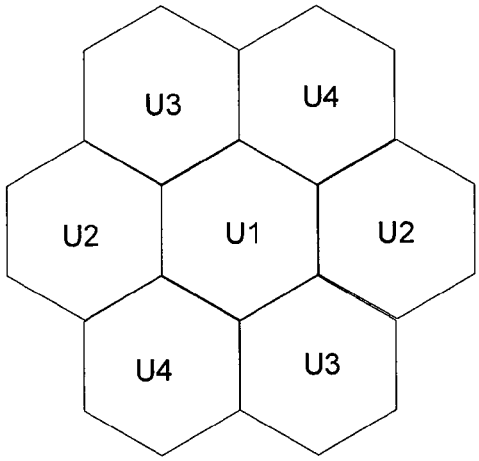
Figure 13:
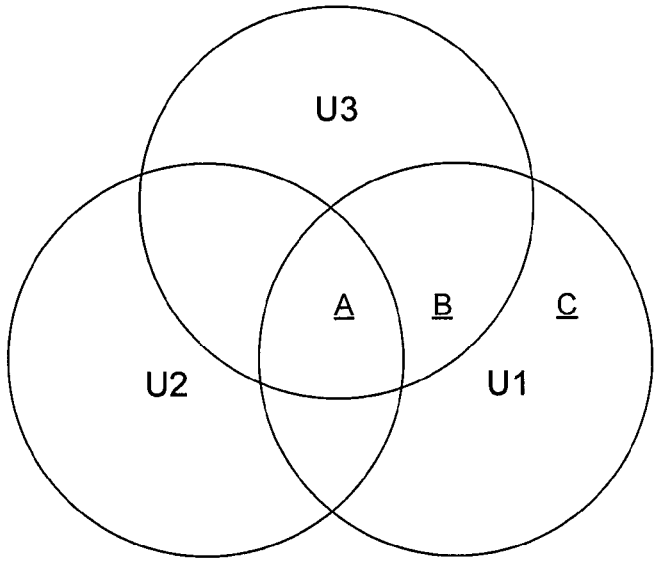

In accordance with an exemplary embodiment, and with reference to FIG. 13, a satellite may have a downlink, an uplink, and a coverage area. The coverage area may be comprised of smaller regions each corresponding to a spot beam to illuminate the respective region. Spot beams may be adjacent to one another and have overlapping regions. A satellite communications system has many parameters to work: (1) number of orthogonal time or frequency slots (defined as color patterns hereafter); (2) beam spacing (characterized by the beam roll-off at the cross-over point); (3) frequency re-use patterns (the re-use patterns can be regular in structures, where a uniformly distributed capacity is required); and (4) numbers of beams (a satellite with more beams will provide more system flexibility and better bandwidth efficiency). Polarization may be used as a quantity to define a re-use pattern in addition to time or frequency slots. In one exemplary embodiment, the spot beams may comprise a first spot beam and a second spot beam. The first spot beam may illuminate a first region within a geographic area, in order to send information to a first plurality of subscriber terminals. The second spot beam may illuminate a second region within the geographic area and adjacent to the first region, in order to send information to a second plurality of subscriber terminals. The first and second regions may overlap.

The first spot beam may have a first characteristic polarization. The second spot beam may have a second characteristic polarization that is orthogonal to the first polarization. The polarization orthogonality serves to provide an isolation quantity between adjacent beams. Polarization may be combined with frequency slots to achieve a higher degree of isolation between adjacent beams and their respective coverage areas. The subscriber terminals in the first beam may have a polarization that matches the first characteristic polarization. The subscriber terminals in the second beam may have a polarization that matches the second characteristic polarization. The subscriber terminals in the overlap region of the adjacent beams may be optionally assigned to the first beam or to the second beam. This optional assignment is a flexibility within the satellite system and may be altered through reassignment following the start of service for any subscriber terminals within the overlapping region. The ability to remotely change the polarization of a subscriber terminal in an overlapping region illuminated by adjacent spot beams is an important improvement in the operation and optimization of the use of the satellite resources for changing subscriber distributions and quantities. For example it may be an efficient use of satellite resources and improvement to the individual subscriber service to reassign a user or a group of users from a first beam to a second beam or from a second beam to a first beam. Satellite systems using polarization as a quantity to provide isolation between adjacent beams may thus be configured to change the polarization remotely by sending a signal containing a command to switch or change the polarization form a first polarization state to a second orthogonal polarization state. The intentional changing of the polarization may facilitate reassignment to an adjacent beam in a spot beam satellite system using polarization for increasing a beam isolation quantity.

In accordance with an exemplary embodiment, the system is configured to facilitate remote addressability of subscriber terminals. In one exemplary embodiment, the system is configured to remotely address a specific terminal. The system may be configured to address each subscriber terminal. In another exemplary embodiment, a group of subscriber terminals may be addressable. Thus, a remote signal may command a terminal or group of terminals to switch from one color to another color. The terminals may be addressable in any suitable manner. In one exemplary embodiment, an IP address is associated with each terminal. In an exemplary embodiment, the terminals may be addressable through the modems or set top boxes. Thus, in accordance with an exemplary embodiment, the system is configured for remotely changing a characteristic polarization of a subscriber terminal by sending a command addressed to a particular terminal.

The down link may comprise multiple "colors" based on combinations of selected frequency and/or polarizations. Although other frequencies and frequency ranges may be used, and other polarizations as well, an example is provided of one multicolor embodiment. For example, in the downlink, colors U1, U3, and U5 are Left-Hand Circular Polarized ("LHCP") and colors U2, U4, and U6 are Right-Hand Circular Polarized ("RHCP"). In the frequency domain, colors U3 and U4 are from 18.3-18.8 GHz; U5 and U6 are from 18.8-19.3 GHz; and U1 and U2 are from 19.7-20.2 GHz. It will be noted that in this exemplary embodiment, each color represents a 500 MHz frequency range. Other frequency ranges may be used in other exemplary embodiments. Thus, selecting one of LHCP or RHCP and designating a frequency band from among the options available will specify a color. Similarly, the uplink comprises frequency/polarization combinations that can be each designated as a color. Often, the LHCP and RHCP are reversed as illustrated, providing increased signal isolation, but this is not necessary. In the uplink, colors U1, U3, and U5 are RHCP and colors U2, U4, and U6 are LHCP. In the frequency domain, colors U3 and U4 are from 28.1-28.6 GHz; U5 and U6 are from 28.6-29.1 GHz; and U1 and U2 are from 29.5-30.0 GHz. It will be noted that in this exemplary embodiment, each color similarly represents a 500 MHz frequency range.

In an exemplary embodiment, the satellite may broadcast multiple spot beams. Some of the spot beams are of one color and others are of a different color. For signal separation, the spot beams of similar color are typically not located adjacent to each other. In an exemplary embodiment, and with reference again to FIG. 13, the distribution pattern illustrated provides one exemplary layout pattern for four color spot beam frequency re-use. It should be recognized that with this pattern, color U1 will not be next to another color U1, etc. It should be noted, however, that typically the spot beams will over lap and that the spot beams may be better represented with circular areas of coverage. Furthermore, it should be appreciated that the strength of the signal may decrease with distance from the center of the circle, so that the circle is only an approximation of the coverage of the particular spot beam. The circular areas of coverage may be overlaid on a map to determine what spot beam(s) are available in a particular area.

Thus, an individual with a four color switchable transceiver that is located at location A on the map (see FIG. 13, Practical Distribution Illustration), would have available to them colors U1, U2, and U3. The transceiver could be switched to operate on one of those three colors as best suits the needs at the time. Likewise, location B on the map would have colors U1 and U3 available. Lastly, location C on the map would have color U1 available. In many practical circumstances, a transceiver will have two or three color options available in a particular area.

It should be noted that colors U5 and U6 might also be used and further increase the options of colors to use in a spot beam pattern. This may also further increase the options available to a particular transceiver in a particular location. Although described as a four or six color embodiment, any suitable number of colors may be used for color switching as described herein. Also, although described herein as a satellite, it is intended that the description is valid for other similar remote communication systems that are configured to communicate with the transceiver.

The frequency range/polarization of the terminal may be selected at least one of remotely, locally, manually, or some combination thereof. In one exemplary embodiment, the terminal is configured to be remotely controlled to switch from one frequency range/polarization to another. For example, the terminal may receive a signal from a central system that controls switching the frequency range/polarization. The central system may determine that load changes have significantly slowed down the left hand polarized channel, but that the right hand polarized channel has available bandwidth. The central system could then remotely switch the polarization of a number of terminals. This would improve channel availability for switched and non-switched users alike. Moreover, the units to switch may be selected based on geography, weather, use characteristics, individual bandwidth requirements, and/or other considerations. Furthermore, the switching of frequency range/polarization could be in response to the customer calling the company about poor transmission quality.

It should be noted that although described herein in the context of switching both frequency range and polarization, benefits and advantages similar to those discussed herein may be realized when switching just one of frequency or polarization.

The frequency range switching described herein may be performed in any number of ways. In an exemplary embodiment, the frequency range switching is performed electronically. For example, the frequency range switching may be implemented by adjusting phase shifters in a phased array, switching between fixed frequency oscillators or converters, and/or a tunable dual conversion transmitter comprising a tunable oscillator signal. Additional aspects of frequency switching for use with the present invention are disclosed in a co-pending U.S. patent application entitled "DUAL CONVERSION TRANSMITTER WITH SINGLE LOCAL OSCILLATOR" having the same filing date as the present application, the contents of which are hereby incorporated by reference in their entirety.

In accordance with another exemplary embodiment, the polarization switching described herein may be performed in any number of ways. In an exemplary embodiment, the polarization switching is performed electronically by adjusting the relative phase of signals at orthogonal antenna ports, or in another embodiment mechanically. For example, the polarization switching may be implemented by use of a trumpet switch. The trumpet switch may be actuated electronically. For example, the trumpet switch may be actuated by electronic magnet, servo, an inductor, a solenoid, a spring, a motor, an electro-mechanical device, or any combination thereof. Moreover, the switching mechanism can be any mechanism configured to move and maintain the position of trumpet switch. Furthermore, in an exemplary embodiment, trumpet switch is held in position by a latching mechanism. The latching mechanism, for example, may be fixed magnets. The latching mechanism keeps trumpet switch in place until the antenna is switched to another polarization.

As described herein, the terminal may be configured to receive a signal causing switching and the signal may be from a remote source. For example, the remote source may be a central office. In another example, an installer or customer can switch the polarization using a local computer connected to the terminal which sends commands to the switch. In another embodiment, an installer or customer can switch the polarization using the television set-top box which in turn sends signals to the switch. The polarization switching may occur during installation, as a means to increase performance, or as another option for troubleshooting poor performance.

In other exemplary embodiments, manual methods may be used to change a terminal from one polarization to another. This can be accomplished by physically moving a switch within the housing of the system or by extending the switch outside the housing to make it easier to manually switch the polarization. This could be done by either an installer or customer.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The invention claimed is:

1. A bend-twist transition section of a waveguide, the bend-twist transition section comprising:

a horizontal channel portion and a horizontal transition portion;

a vertical channel portion and a vertical transition portion; and a common bisecting plane of the horizontal and vertical channel portions formed by a connection-edge plane in the waveguide;

wherein the bend-twist transition section is configured to communicate a signal between the horizontal channel portion and the vertical channel portion;

wherein the bend-twist transition section is configured to change a geometrical orientation of an electric field of the signal by 90 degrees and change a direction of the signal by 90 degrees;

wherein the horizontal transition portion is progressively stepped down until below the common bisecting plane;

wherein the horizontal transition portion and the vertical transition portion intersect with the horizontal transition portion being below the common bisecting plane;

wherein the vertical transition portion orthogonally intersects the horizontal transition portion at the common bisecting plane; and wherein the vertical transition portion also intersects the horizontal transition portion orthogonally with respect to the common bisecting plane.

2. A bend-twist transition section of a waveguide, the bend-twist transition section comprising:

a horizontal channel portion and a horizontal transition portion;

a vertical channel portion and a vertical transition portion;

a common bisecting plane of the horizontal and vertical channel portions formed by a connection-edge plane in the waveguide;

wherein the bend-twist transition section is configured to communicate a signal between the horizontal channel portion and the vertical channel portion; and wherein the bend-twist transition section is configured to change a geometrical orientation of an electric field of the signal by 90 degrees and change a direction of the signal by 90 degrees;

each of the vertical transition portion and the horizontal transition portion comprises a top half and a bottom half;

wherein the bottom half of the horizontal transition portion becomes deeper towards the intersection of the vertical and horizontal transition portions;

wherein the top half of the horizontal transition portion becomes shallower towards the intersection of vertical and horizontal transition portions; and wherein the vertical transition portion narrows from the vertical channel portion towards the intersection of the vertical and horizontal transition portions.

3. The bend-twist transition section of claim 2, wherein the top half of the vertical transition portion does not intersect with the top half of the horizontal transition portion, and wherein the bottom half of the vertical transition portion intersects with the bottom half of the horizontal transition portion at a right angle.

4. The bend-twist transition section of claim 3, wherein the top half of the vertical transition portion overlaps the bottom half of the horizontal transition portion at the intersection of the vertical and horizontal transition portions.

5. The bend-twist transition section of claim 3, wherein the top half of the vertical transition portion is fully connected to the bottom half of the vertical transition portion at the intersection of the vertical and horizontal transition portions.

6. An orthomode transducer (OMT) comprising:

a common port configured to support a first frequency band segment and a second frequency band segment and configured to support two polarizations of operation;

a common waveguide channel along a central axis of the common port;

a first junction and a second junction located along the common waveguide channel, wherein the first junction and the second junction are orthogonal to each other;

a third junction and a fourth junction located along the common waveguide channel, wherein the third junction and the fourth junction are orthogonal to each other;

wherein the first junction, the third junction and the fourth junction are all connected to the common waveguide channel in a common plane, and wherein the second junction is connected to the common waveguide channel in a plane orthogonal to the common plane;

a crossover component connected to the common waveguide channel at the second junction, wherein the crossover component is configured to connect the common waveguide channel to a second waveguide channel;

a first waveguide channel in the common plane, wherein the first junction is associated with the first waveguide channel;

wherein the second waveguide channel is in the common plane, and wherein the second junction is associated with the second waveguide channel;

a third waveguide channel in the common plane, wherein the third junction is associated with the third waveguide channel; and a fourth waveguide channel in the common plane, wherein the fourth junction is associated with the fourth waveguide channel.

7. The OMT of claim 6, wherein the crossover component is C-shaped.

8. The OMT of claim 6, wherein the crossover component comprises filtering elements configured to increase an isolation quantity between the common waveguide channel and the second waveguide channel of the OMT.

9. The OMT of claim 6, wherein the first frequency band segment is the K-band having a bandwidth of approximately 1900 MHz, and wherein the second frequency band segment is the Ka-band having a bandwidth of approximately 1900 MHz.

10. The OMT of claim 6, wherein the first frequency band segment receives a receive signal in a frequency range of 18.3-20.2 GHz, and wherein the second frequency band segment transmits a transmit signal in a frequency range of 28.1-30.0 GHz.

11. The OMT of claim 6, wherein the first waveguide channel and the third waveguide channel operate in a first polarization of said two polarizations, wherein the second waveguide channel and the fourth waveguide channel operate in a second polarization of said two polarizations, and wherein the first polarization is different than the second polarization.

12. The OMT of claim 11, wherein the OMT is configured to switch operating between one of the first and fourth waveguide channels or the second and third waveguide channels.

13. The OMT of claim 6, wherein the sequential physical order from the common port along the common waveguide channel is the first junction, the second junction, the third junction, and the fourth junction.

14. The OMT of claim 6, further comprising a plurality of transition distances, wherein the plurality of transition distances include individual transition distances between: the common port and the first junction, the first junction and the second junction, the second junction and the third junction, and the third junction and the fourth junction;

wherein the individual transition distance between the second junction to the third junction transition has a length longer than the remainder of the plurality of transition distances.

15. The OMT of claim 6, wherein a cross-section area of the common waveguide channel at the third junction is larger than a cross-section area of the common waveguide channel at the second junction.

16. The OMT of claim 6, wherein the first frequency band segment is associated with the first and second junctions, and wherein the second frequency hand segment is associated with the third and fourth junctions.

* * * * *